US010820708B2

(12) United States Patent
LaPointe et al.

(10) Patent No.: US 10,820,708 B2
(45) Date of Patent: Nov. 3, 2020

(54) FURNITURE MEMBER WITH WALL-PROXIMITY MECHANISM AND LOCKING TRIGGER

(71) Applicant: La-Z-Boy Incorporated, Monroe, MI (US)

(72) Inventors: Larry P. LaPointe, Temperance, MI (US); Chad E. Adams, Perrysburg, OH (US); Gerald G. Stotz, Ida, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 16/414,157

(22) Filed: May 16, 2019

(65) Prior Publication Data

US 2019/0350368 A1 Nov. 21, 2019

Related U.S. Application Data

(60) Provisional application No. 62/673,370, filed on May 18, 2018.

(51) Int. Cl.
*A47C 1/02* (2006.01)
*A47C 1/024* (2006.01)
(Continued)

(52) U.S. Cl.
CPC ..... *A47C 7/506* (2013.01); *A47C 1/027* (2013.01)

(58) Field of Classification Search
CPC ..... A47C 7/506; A47C 1/027
(Continued)

(56) References Cited

U.S. PATENT DOCUMENTS 203,602 A 5/1878 Dietsch
1,182,854 A 5/1916 Poler
(Continued)

FOREIGN PATENT DOCUMENTS

CN 200976974 Y 11/2007
DE 623960 C 1/1936
(Continued)

OTHER PUBLICATIONS

International Search Report for Application No. PCT/US2019/021568, dated Jun. 20, 2019.
(Continued)

*Primary Examiner* — Rodney B White
(74) *Attorney, Agent, or Firm* — Harness, Dickey & Pierce, P.L.C.

(57) ABSTRACT

A furniture member includes a base frame and a seat assembly supported by the base frame. The seat assembly includes a seat frame, a seat bottom, a seatback and a legrest. The legrest is movable relative to the base frame and seat frame between a retracted position and an extended position. The furniture member further includes a legrest mechanism attached to the legrest and the seat frame and driven by a drive rod configured to move the legrest between the retracted and extended positions in response to rotation of the drive rod. A wall-proximity mechanism is configured to translate the seat frame forward relative to the base frame. A trigger release mechanism is operable between a locked position in which a trigger limits rotation of the drive rod and a released position in which the trigger permits rotation of the drive rod.

21 Claims, 24 Drawing Sheets

(51) Int. Cl.

| | |
|---|---|
| ***A47C 1/032*** | (2006.01) |
| ***A47C 1/034*** | (2006.01) |
| ***A47C 1/035*** | (2006.01) |
| ***A47C 7/50*** | (2006.01) |
| ***A47C 1/027*** | (2006.01) |

(58) Field of Classification Search
USPC ..... 297/83, 84, 85 R, 85 M, 85 L
See application file for complete search history.

(56) References Cited

U.S. PATENT DOCUMENTS 1,414,637 A 5/1922 Gell
2,473,895 A 6/1949 Mednick
2,677,412 A 5/1954 Thomas
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,099,776 A 7/1978 Crum
4,140,342 A 2/1979 Jones
4,179,157 A 12/1979 Shoemaker et al.
4,212,494 A 7/1980 Dabney
4,216,991 A 8/1980 Holobaugh
4,216,992 A 8/1980 Crum
4,226,468 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,861,101 A 8/1989 Hartline
4,895,411 A 1/1990 Pine
4,932,927 A 6/1990 Fillar
4,989,914 A 2/1991 Pine
5,011,220 A 4/1991 LaPointe
5,044,692 A 9/1991 Tidwell, Jr. et al.
5,054,850 A 10/1991 Pine
5,064,244 A 11/1991 Sproule
5,072,988 A 12/1991 Plunk
5,088,789 A 2/1992 LaPointe et al.
5,123,705 A 6/1992 Johnson
5,129,701 A 7/1992 Pine
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,271,660 A * 12/1993 LaPointe ..... A47C 1/0352 297/85 L
5,323,526 A * 6/1994 Saul ..... A47C 13/005 297/83 X
5,328,235 A 7/1994 Saul et al.
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A 1/1996 Sproule
5,503,453 A 4/1996 Saul et al.
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A 12/1996 Komorowski et al.
5,597,209 A 1/1997 Bart et al.
5,664,832 A 9/1997 Stevens et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,857,739 A 1/1999 Smith
5,865,457 A 2/1999 Knabusch et al.
5,954,392 A 9/1999 Liss et al.
5,971,475 A 10/1999 Lawson
5,975,627 A 11/1999 LaPointe et al.
5,992,930 A * 11/1999 LaPointe ..... A47C 1/0355 297/84 X
6,000,754 A 12/1999 Lawson
6,145,924 A * 11/2000 Mero, Jr. ..... A47C 1/0352 297/83 X
6,179,328 B1 1/2001 Kawagoe et al.
6,231,120 B1 * 5/2001 Wiecek ..... A47C 1/035 297/84 X
6,309,015 B1 10/2001 Pine
6,330,995 B1 12/2001 Mangeiga et al.
6,409,262 B1 * 6/2002 LaPointe ..... A47C 1/0352 297/83 X
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,988,769 B2 1/2006 LaPointe
7,261,367 B2 8/2007 Duncan et al.
7,275,789 B2 10/2007 LaPointe
7,338,132 B2 3/2008 LaPointe
7,357,450 B2 4/2008 Rogers
7,431,387 B2 10/2008 LaPointe et al.
7,475,944 B2 1/2009 Griepentrog et al.
7,637,571 B2 12/2009 Okano et al.
7,673,933 B2 3/2010 Lawson
7,731,276 B2 6/2010 Hoffman et al.
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,986,832 B2 6/2018 LaPointe et al.
9,986,835 B2 6/2018 LaPointe et al.
10,092,106 B2 10/2018 LaPointe et al.
2001/0026088 A1 10/2001 Robinson
2003/0057743 A1 3/2003 May
2004/0000803 A1 1/2004 Guillot et al.
2005/0067867 A1 3/2005 May
2006/0061147 A1 3/2006 Johnson

(56) References Cited

U.S. PATENT DOCUMENTS

| | | | |
|---|---|---|---|
| 2006/0103202 | A1 | 5/2006 | Maki et al. |
| 2006/0249992 | A1 | 11/2006 | LaPointe et al. |
| 2006/0249993 | A1 | 11/2006 | Rogers |
| 2007/0040419 | A1 | 2/2007 | LaPointe et al. |
| 2007/0085395 | A1 | 4/2007 | LaPointe |
| 2007/0241589 | A1 | 10/2007 | LaPointe |
| 2008/0129006 | A1 | 6/2008 | Johnson et al. |
| 2008/0150329 | A1 | 6/2008 | Lawson |
| 2009/0284054 | A1 | 11/2009 | Humer et al. |
| 2011/0016627 | A1 | 1/2011 | Blevins et al. |
| 2011/0175426 | A1 | 7/2011 | Lawson |
| 2011/0233972 | A1 | 9/2011 | Weicek |
| 2011/0248544 | A1 | 10/2011 | Adams et al. |
| 2011/0248547 | A1 | 10/2011 | LaPointe et al. |
| 2011/0304193 | A1 | 12/2011 | Murphy et al. |
| 2012/0193946 | A1 | 8/2012 | Robertson |
| 2013/0062914 | A1 | 3/2013 | Marshall et al. |
| 2013/0140855 | A1 | 6/2013 | Murphy et al. |
| 2013/0175847 | A1 | 7/2013 | Lawson |
| 2014/0049079 | A1 | 2/2014 | Lawson et al. |
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0312660 | A1 | 10/2014 | Natuzzi et al. |
| 2014/0333099 | A1 | 11/2014 | Lu et al. |
| 2014/0368011 | A1 | 12/2014 | LaPointe |
| 2015/0196123 | A1 | 7/2015 | Buehrer |
| 2015/0250320 | A1 | 9/2015 | Arceci et al. |
| 2015/0272329 | A1 | 10/2015 | Lawson |
| 2015/0282619 | A1 | 10/2015 | Lawson |
| 2016/0058195 | A1 | 3/2016 | Huang et al. |
| 2016/0100687 | A1 | 4/2016 | Murphy |
| 2016/0302573 | A1 | 10/2016 | Garland et al. |
| 2016/0325838 | A1 | 11/2016 | Erhel |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0206644 | A1 | 7/2018 | Murphy |
| 2018/0228290 | A1 | 8/2018 | Kiwak et al. |
| 2018/0289156 | A1 | 10/2018 | Marshall et al. |
| 2018/0289157 | A1 | 10/2018 | Marshall et al. |
| 2018/0289158 | A1 | 10/2018 | Marshall et al. |
| 2019/0116981 | A1 | 4/2019 | LaPointe et al. |
| 2019/0313796 | A1 | 10/2019 | LaPointe |
| 2019/0350362 | A1 | 11/2019 | LaPointe et al. |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| JP | 3198305 | U | 6/2015 |
| KR | 1020060036132 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015066030 | A1 | 5/2015 |
| WO | WO-2017155069 | A1 | 9/2017 |

OTHER PUBLICATIONS

Written Opinion of the International Searching Authority for Application No. PCT/US2019/021568, dated Jun. 20, 2019.
International Search Report for Application No. PCT/US2006/031852, dated Jun. 17, 2008.
Written Opinion of the International Searching Authority for Application No. PCT/US2006/031852, dated Jun. 17, 2008.
International Search Report for Application No. PCT/US2014/019455, dated May 26, 2014.
Written Opinion of the International Searching Authority for Application No. PCT/US2014/019455, dated May 26, 2014.
International Search Report for Application No. PCT/US2016/021361, dated May 30, 2016.
Written Opinion of the International Searching Authority for Application No. PCT/US2016/021361, dated May 30, 2016.
International Search Report for Application No. PCT/US2016/032967 dated Aug. 19, 2016.
Written Opinion of the International Searching Authority for Application No. PCT/US2016/032967 dated Aug. 19, 2016.
International Search Report for Application No. PCT/US2017/035976, dated Aug. 25, 2017.
Written Opinion of the International Searching Authority for Application No. PCT/US2017/035976, dated Aug. 25, 2017.
International Search Report for Application No. PCT/US2017/043899, dated Nov. 8, 2017.
Written Opinion of the International Searching Authority for Application No. PCT/US2017/043899, dated Nov. 8, 2017.
International Search Report for Application No. PCT/US2018/025467, dated Jul. 17, 2018.
Written Opinion of the International Searching Authority for Application No. PCT/US2018/025467, dated Jul. 17, 2018.
European Search Report for Application No. 18159817.8, dated Sep. 26, 2018.
European Search Report for Application No. 16824840.9, dated Dec. 7, 2018.
First Examination Report for New Zealand Application No. 738919, dated Mar. 14, 2019.
European Search Report for Application No. 19158581.9, dated May 3, 2019.
International Search Report for Application No. PCT/US2019/064607, dated Mar. 26, 2020.
Written Opinion of the International Searching Authority for Application No. PCT/US2019/064607, dated Mar. 26, 2020.

* cited by examiner

FURNITURE MEMBER WITH WALL-PROXIMITY MECHANISM AND LOCKING TRIGGER

CROSS-REFERENCE TO RELATED APPLICATIONS

This application claims the benefit of U.S. Provisional Application No. 62/673,370, filed on May 18, 2018. The entire disclosure of the above application is incorporated herein by reference.

FIELD

The present disclosure relates to a furniture member with a wall-proximity mechanism and a locking trigger.

BACKGROUND

This section provides background information related to the present disclosure which is not necessarily prior art.

Conventional reclining chairs or sofas must be positioned far enough away from a wall or any other object in a room to provide enough space behind the chair or sofa so that the wall does not restrict the ability of a seatback of the chair or sofa to move into a fully reclined position. This can result in the user having to position the chair or sofa farther away from the wall than he or she would choose to position a non-reclining chair or sofa in order to leave space for the seatback to fully recline. The present disclosure provides a furniture member that translates a frame of the furniture member forward as the seatback reclines, such that a distance between the wall and the seatback is the same or nearly the same in both an upright position and in a fully reclined position. The translation of the frame may be activated via a manually-operated linkage.

The present disclosure also provides a furniture member with a spring assist mechanism and a trigger release mechanism. The spring assist mechanism operates to counteract the weight of an occupant's legs on the legrest when the legrest is in the extended position. The trigger release mechanism operates to lock the legrest in the retracted position until the trigger release mechanism is moved to a released position.

SUMMARY

This section provides a general summary of the disclosure, and is not a comprehensive disclosure of its full scope or all of its features.

An aspect of the present disclosure provides a furniture member comprising a base frame and a seat assembly supported by the base frame. The seat assembly includes a seat frame, a seat bottom, a seatback and a legrest. The legrest is movable relative to the base frame and seat frame between a retracted position and an extended position. The seatback is movable relative to the base frame and seat frame between an upright position and a reclined position. The furniture member further comprises a drive rod rotatably mounted to the seat frame and a legrest mechanism attached to the legrest and the seat frame and driven by the drive rod configured to move the legrest between the retracted and extended positions in response to rotation of the drive rod. The furniture member also comprises a wall-proximity mechanism connected to the base frame. The wall-proximity mechanism is configured to translate the seat frame forward relative to the base frame. The furniture member further comprises a trigger release mechanism connected to the seat frame and the drive rod. The trigger release mechanism operable between a locked position in which a trigger limits rotation of the drive rod and a released position in which the trigger permits rotation of the drive rod.

In some configurations, the trigger release mechanism includes a cam connected to the drive rod. The trigger engaging the cam in the locked position to limit rotation of the drive rod and rotating away from the cam to disengage the cam in the released position to permit rotation of the drive rod.

In some configurations, the trigger release mechanism further includes a biasing member. The biasing member biases the trigger against the cam.

In some configurations, the trigger release mechanism prevents the legrest from moving from the retracted position to the extended position when the trigger release mechanism is in the locked position.

In some configurations, the trigger release mechanism further includes a cable connected to the trigger. The cable is operable to rotate the trigger away from the cam in response to an input by an occupant of the furniture member.

In some configurations, the trigger engages the cam to move the trigger release mechanism to the locked position when the legrest is moved from the extended position to the retracted position.

In some configurations, the furniture member further comprises a spring assist mechanism operable to urge the legrest mechanism to move the legrest from the retracted position to the extended position.

In some configurations, the spring assist mechanism includes a spring, a spring connector and a spacing arm. The spring connector is connected between the spring and the spacing arm and the spacing arm is connected to the drive rod whereby the spring exerts a force on the spacing arm to urge the drive rod to rotate.

In some configurations, the spring connector is connected to the spacing arm at a connection point. The connection point is offset from a center axis of the drive rod by a distance that changes as the drive rod rotates to vary a moment arm at which a force exerted by the spring pulls on the spacing arm to urge the drive rod to rotate.

In some configurations, the spring connector has a rounded shape that curves around the drive rod and the spring connector is spaced apart from the drive rod to permit the spacing arm to rotate with the drive rod.

In some configurations, the distance that the connection point is offset from the center axis of the drive rod becomes larger when the drive rotates to move the legrest from the retracted position to the extended position.

In some configurations, the legrest mechanism includes a pair of pantograph linkages connected to the legrest.

In some configurations, the wall-proximity mechanism includes a first linkage connected to the drive rod. The first linkage includes a first motion link and a second motion link. The first motion link and the second motion link rotatably are connected to a first cross-member and to the base frame. The first motion link is rotatably connected to a first control link on an end opposite to the base frame and the second motion link is rotatably connected to a second control link on an end opposite to the base frame. The first control link and the second control link are rotatably connected to a second cross-member. The first cross-member and the second cross-member are configured to move substantially parallel to one another to translate the seat frame forward relative to the base frame.

In some configurations, the wall-proximity mechanism includes a second linkage connected to the drive rod. The second linkage includes a first swing link, a second swing link, a first pull link, a second pull link and a pivot bracket. The first swing link is rotatably connected to the base frame at one end and to the second swing link at the opposite end. The swing link is rotatably connected to the drive rod. The pivot bracket is connected to the seat bottom and to the first pull link and to the second pull link. The second pull link is connected to the seat frame. The second linkage is configured to translate the seat bottom forward relative to the seat frame.

In another aspect of the present disclosure, another example furniture member is provided. The furniture member comprises a base frame and a seat assembly supported by the base frame. The seat assembly includes a seat frame, a seat bottom, a seatback and a legrest. The furniture member also comprises a drive rod rotatably mounted to the seat frame and a pair of legrest mechanisms mounted laterally outboard of and connected to the drive rod. The pair of legrest mechanisms each includes a pantograph linkage configured to move the legrest from a retracted position to an extended position in response to rotation of the drive rod. The furniture member further comprises a pair of wall-proximity mechanisms mounted laterally outboard of the pair of legrest mechanisms. The pair of wall-proximity mechanisms are connected to the drive rod and each include a first linkage connected to the base frame and the seat frame and a second linkage connected to the first linkage and the seat bottom. The first linkage is configured to move the seat frame forward and the second linkage is configured to move the seat bottom forward. The furniture member also comprises a trigger release mechanism connected to the seat frame and the drive rod. The trigger release mechanism is operable between a locked position in which a trigger limits rotation of the drive rod and a released position in which the trigger permits rotation of the drive rod. The furniture member also comprises a spring assist mechanism connected to the drive rod that is operable to urge the pair of legrest mechanisms to move the legrest from the retracted position to the extended position.

In some configurations, the trigger release mechanism is connected to the seat frame and the drive rod between the pair legrest mechanisms and between the pair of wall-proximity mechanisms.

In some configurations, the trigger is rotatably supported relative to the seat frame by a support link spanning between the drive rod and the seat frame. The trigger release mechanism further includes a cam connected to the drive rod adjacent to the trigger wherein the trigger rotates to engage and disengage the cam to move the trigger release mechanism from the locked position to the released position.

In some configurations, the spring assist mechanism is connected to the drive rod between the pair of legrest mechanisms and between the pair of wall-proximity mechanisms.

In some configurations, the spring assist mechanism includes a spring, a spring connector and a spacing arm. The spacing arm is connected to the drive rod such that the spacing arm rotates with the drive rod around a center axis. The spacing arm is also connected to the spring connector at a connection point. The connection point is offset from the center axis such that a force exerted by the spring at the connection point urges the drive rod to rotate.

In some configurations, the spring is connected to the spring connector on a second end of the spring connector opposite to the connection point. The spring connector has a curved shape between the second end and the connection point.

In another aspect of the present disclosure a furniture member may include a base frame and a seat assembly supported by the base frame. The seat assembly may include a seat frame, a seat bottom, a seatback and a legrest. The legrest may be movable relative to the base frame and seat frame between a retracted position and an extended position and the seatback may be movable relative to the base frame and seat frame between an upright position and a reclined position. The furniture member may also include a drive rod rotatably mounted to the seat frame and a legrest mechanism attached to the legrest and the seat frame wherein the drive rod is configured to move the legrest between the retracted and extended positions in response to rotation of the drive rod. The furniture member may also include a spring assist mechanism connected to the drive rod and operable to urge rotation of the drive rod in a direction to cause the legrest mechanism to move the legrest from the retracted position to the extended position.

In some configurations, the spring assist mechanism includes a spring and a spacing arm. The spring may be coupled to the drive rod at a connecting point on the spacing arm and the connecting point may be offset from a center axis of the drive rod such that a force exerted by the spring at the connecting point urges rotation of the drive rod.

In some configurations, a distance that the connecting point is offset from the center axis of the drive rod changes as the drive rod rotates to vary a moment arm at which the force exerted by the spring pulls on the spacing arm to urge the drive rod to rotate.

In some configurations, the spring assist mechanism includes a spring connector that has a curved shaped that connects the spring to the connecting point of the spacing arm such that the spring is spaced apart from the drive rod.

In some configurations, an end of spacing arm opposite to the connecting point is secured to the drive rod such that the connecting point rotates with drive rod.

In some configurations, the distance that the connecting point is offset from the center axis of the drive rod when the legrest is in the extended position is greater than the distance that the connecting point is offset from the center axis of the drive rod when the legrest is in the retracted position.

In some configurations, the spring connector is rotatably connected to the spacing arm.

In some configurations, the furniture member may further include a trigger release mechanism connected to the seat frame and the drive rod. The trigger release mechanism may be operable between a locked position in which a trigger limits rotation of the drive rod and a released position in which the trigger permits rotation of the drive rod.

In some configurations, the trigger release mechanism includes a cam connected to the drive rod, the trigger engaging the cam in the locked position to limit rotation of the drive rod and rotating away from the cam to disengage the cam in the released position to permit rotation of the drive rod.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
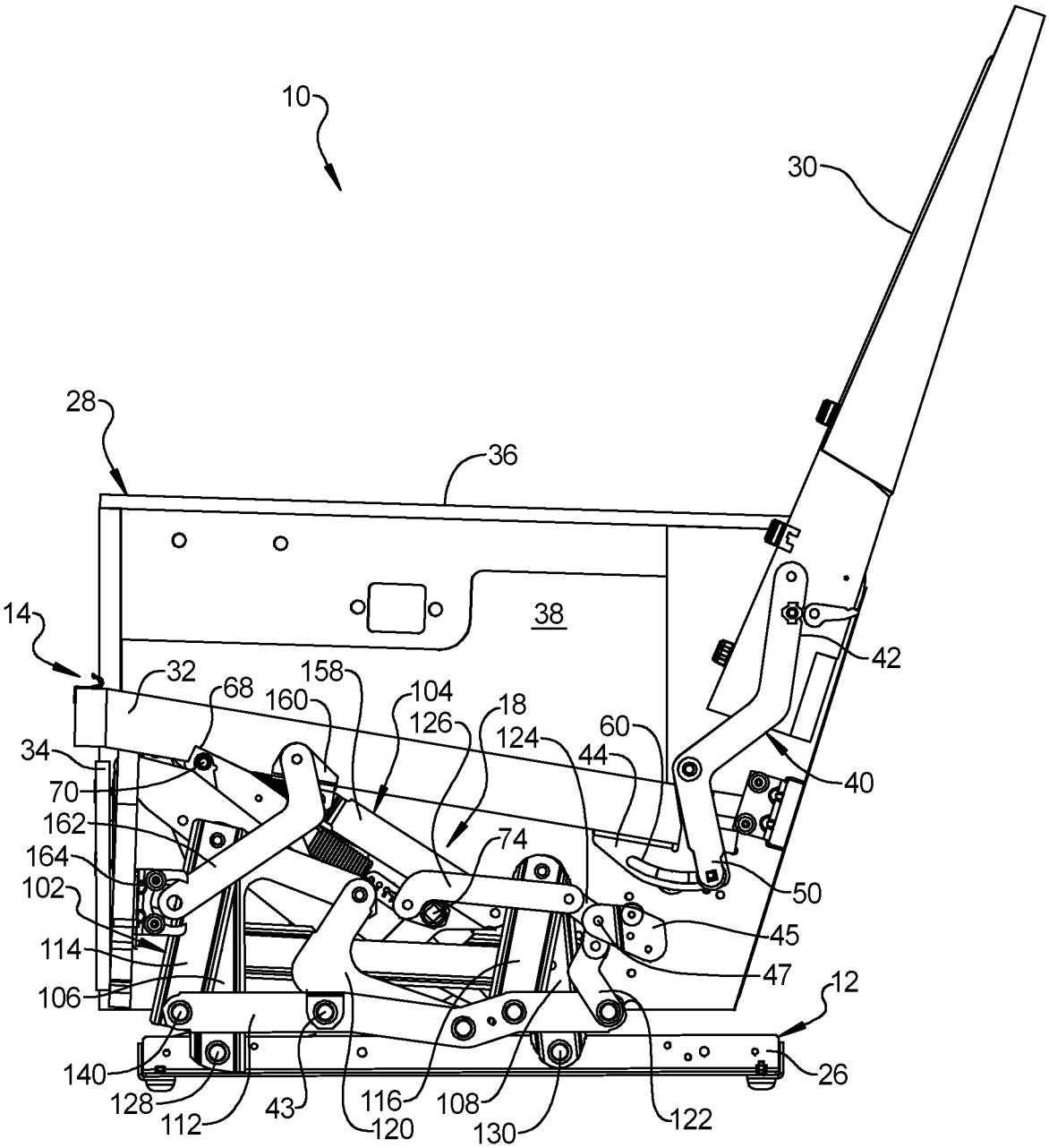
FIG. 1 is a side view of a furniture member with a seatback in an upright position and a legrest in a retracted position according to principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 17:
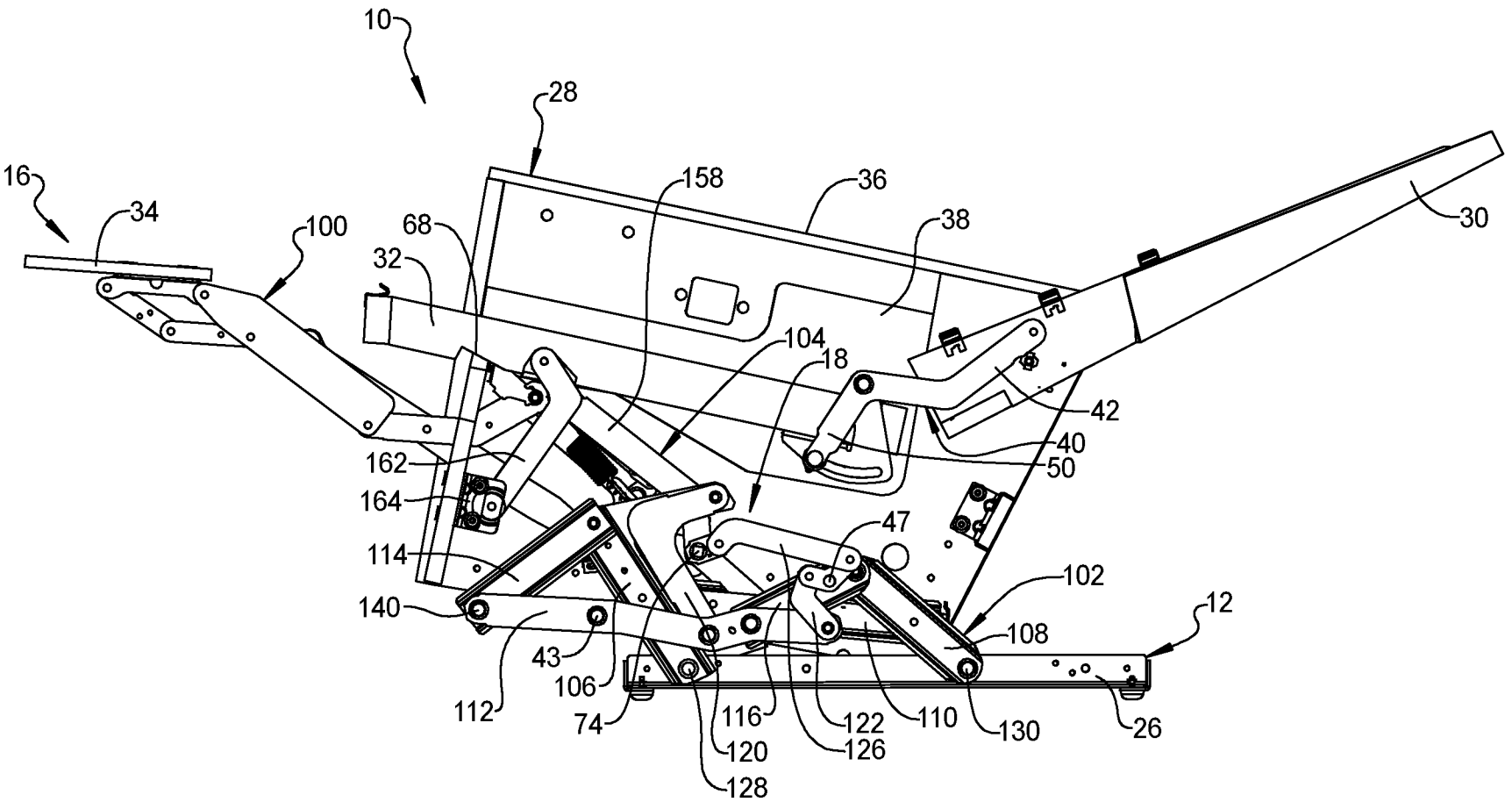
FIG. 17 is a side view of the furniture member with the seatback in a reclined position and the legrest in an extended position according to principles of the present disclosure.
Figure 18:
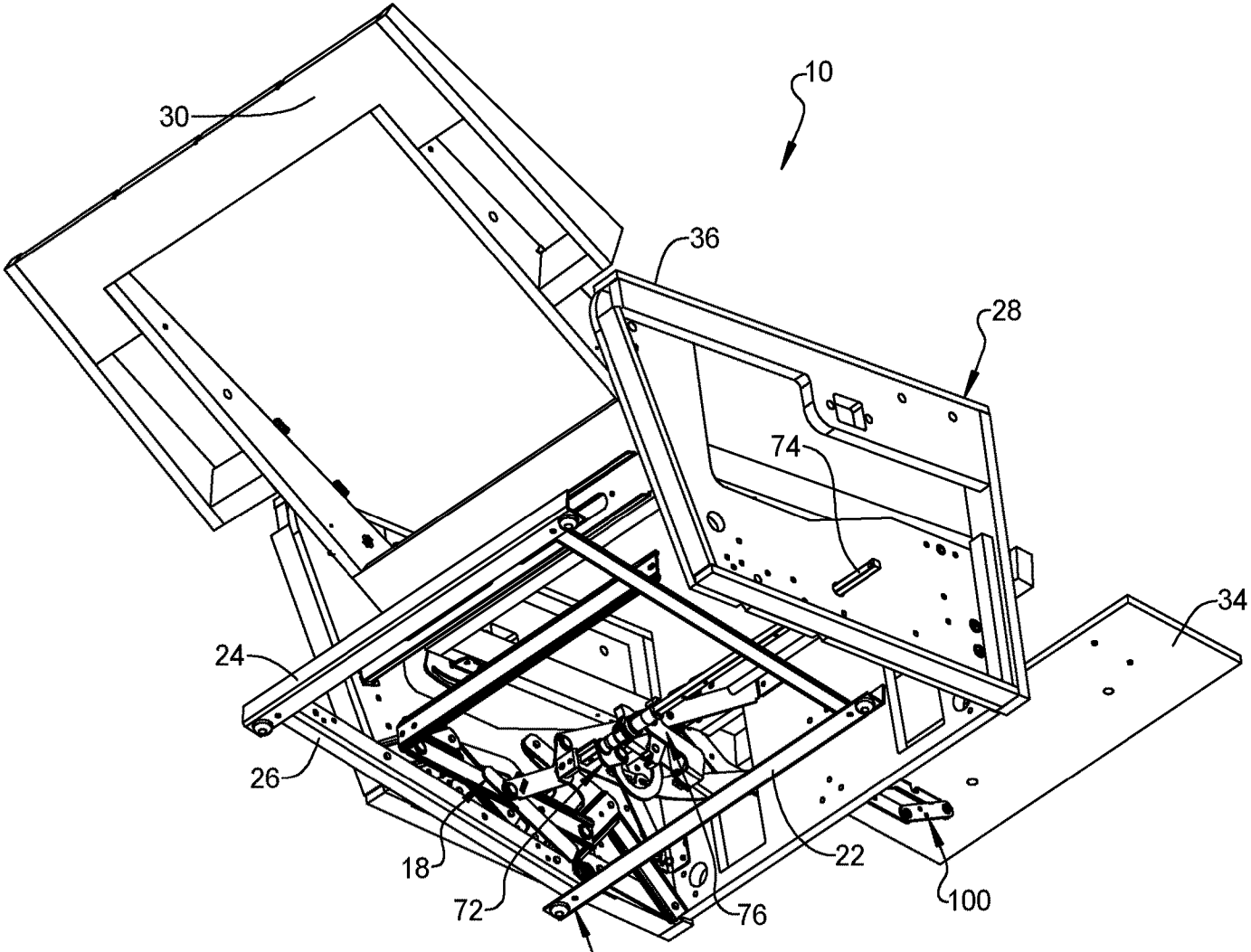
FIG. 18 is a bottom perspective view of the furniture member in the position of FIG. 16.
Figure 19:
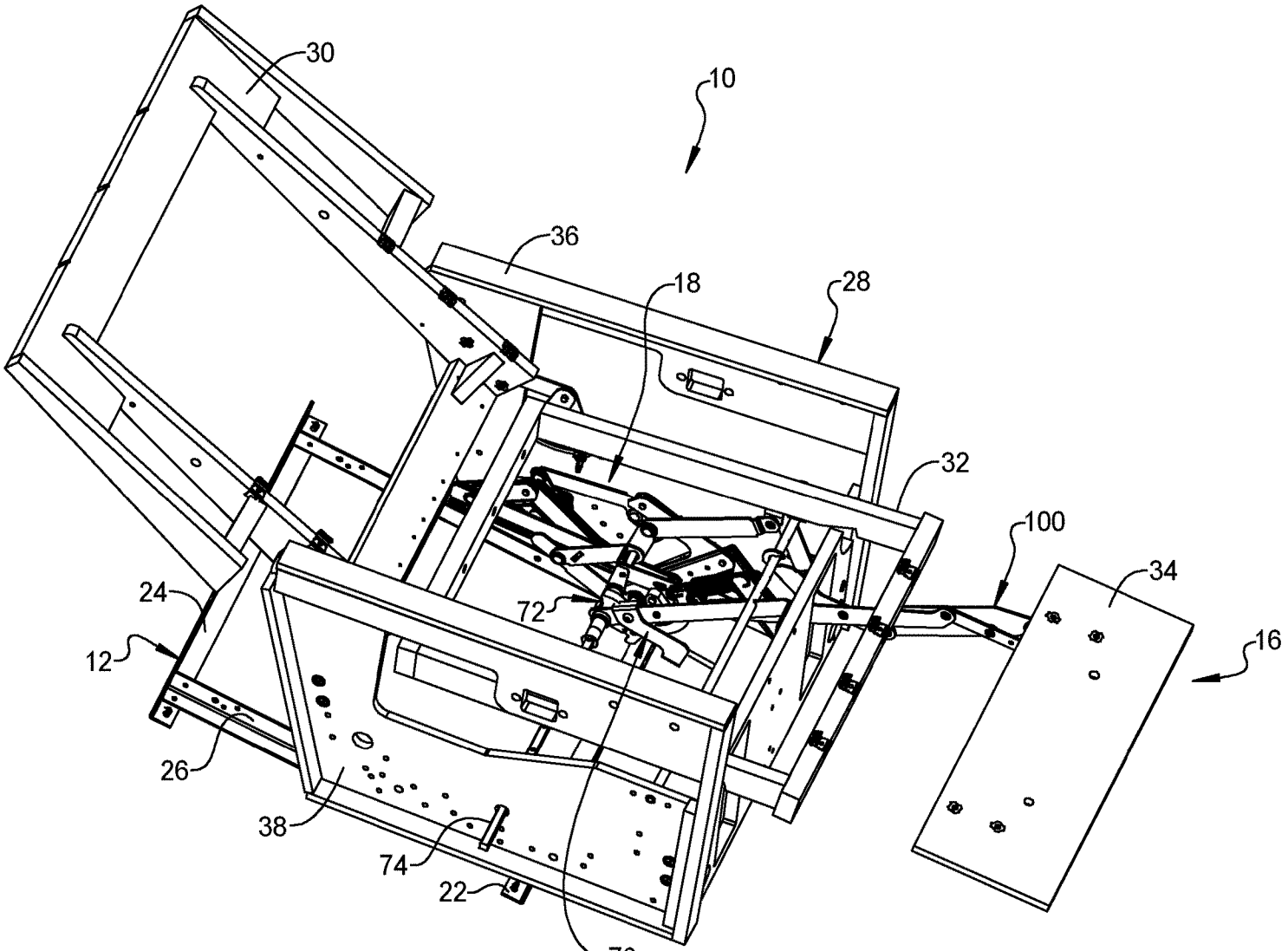
FIG. 19 is a top perspective view of the furniture member in the position of FIG. 16.
Figure 20:
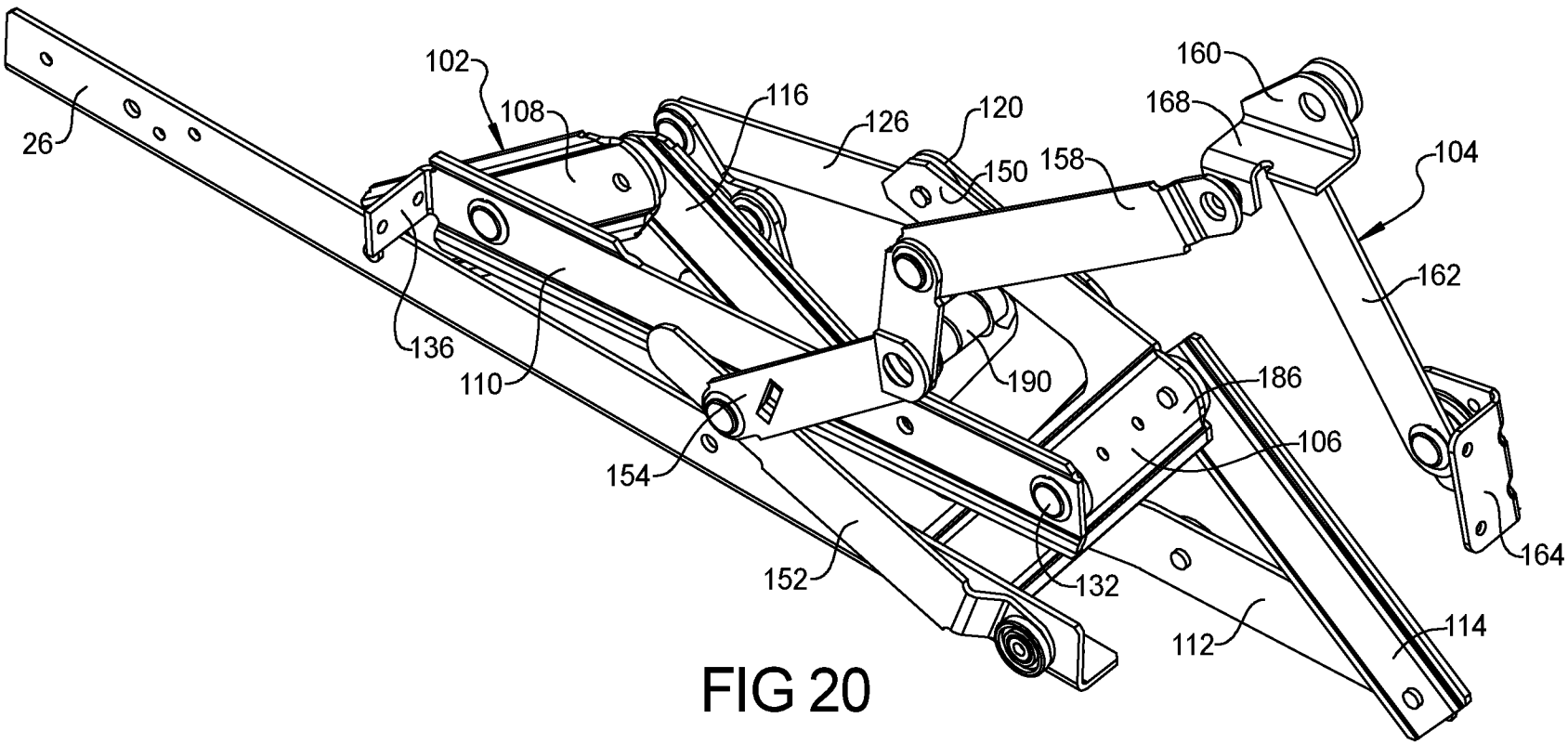
FIG. 20 is a perspective view of the wall-proximity mechanism of the furniture member when the furniture member is in the position of FIG. 16.
Figure 21:
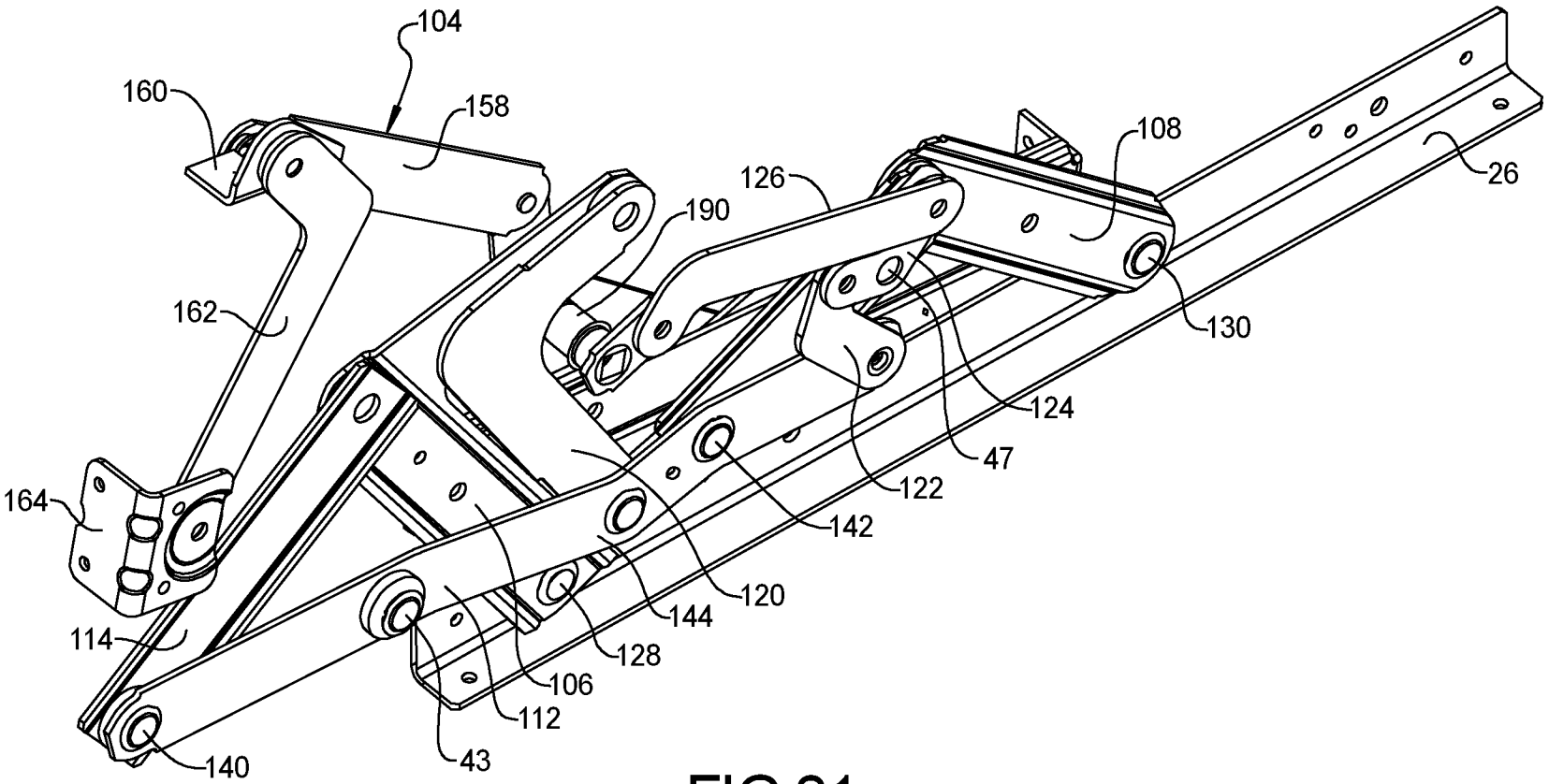
FIG. 21 is a perspective view of an opposite side of the wall-proximity mechanism of the furniture member when the furniture member is in the position of FIG. 16.
Figure 22:
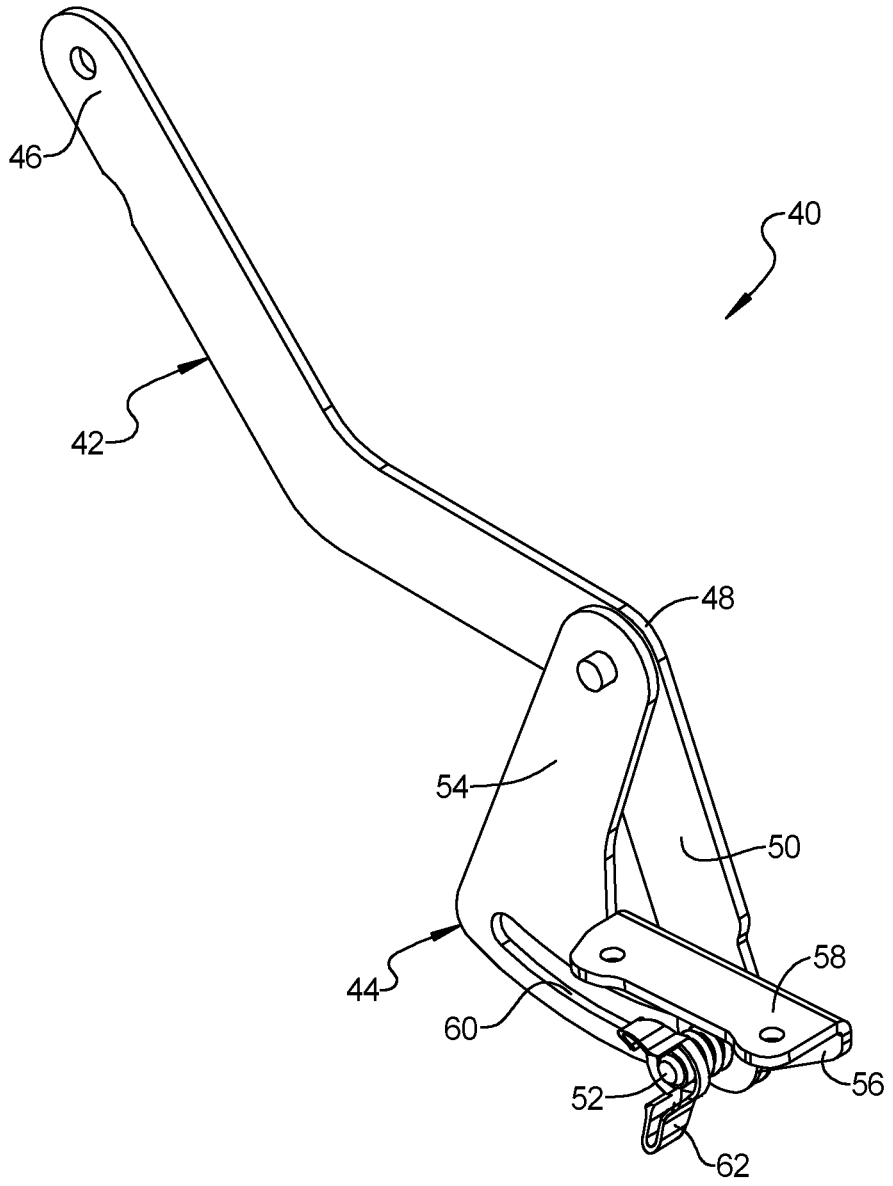
FIG. 22 is a perspective view of the friction-slide mechanism of the furniture member when the seatback is in the reclined position.

With reference to FIGS. 1-22, a furniture member 10 is provided that may include a base frame 12, a seat assembly 14, a legrest mechanism 16, a wall-proximity mechanism 18, and a drive mechanism 20. As will be described in more detail below, the wall-proximity mechanism 18 may tilt the seat assembly 14 rearward relative to the base frame 12 and translate the seat assembly 14 forward relative to the base frame 12 in response to movement of the legrest mechanism 16 between a fully retracted position (FIGS. 1-3) and a fully extended position (FIGS. 10-12) and/or in response to movement of a seatback 30 of the seat assembly 14 between a fully upright position (FIGS. 1-3) and a fully reclined position (FIGS. 17-19).

The furniture member may also include a spring assist mechanism 72 and a trigger release mechanism 76. As will be further described below, the drive mechanism 20 can be a manually-operated mechanism in which an occupant of the furniture member moves a lever (or other input component) that causes the legrest mechanism 16 to move the legrest between the retracted position to the extended position. The spring assist mechanism 72 can supply a force to the drive mechanism 20 that reduces the input force required by the occupant to move the legrest mechanism 16 to the extended position. In addition, the spring assist mechanism 72 can supply a force to the drive mechanism 20 when the legrest mechanism 16 is in the extended position to reduce the likelihood that the legrest mechanism will move to the retracted position unintentionally.

The trigger release mechanism 76 of the furniture member 10 can prevent unwanted movement of the legrest mechanism 16. The trigger release mechanism 76 can be coupled to the drive mechanism 20 such that the trigger release mechanism 76 prevents the drive mechanism 20 from moving the legrest mechanism 16 unless the trigger release mechanism 76 is moved from a locked to a released position.

Figure 2:
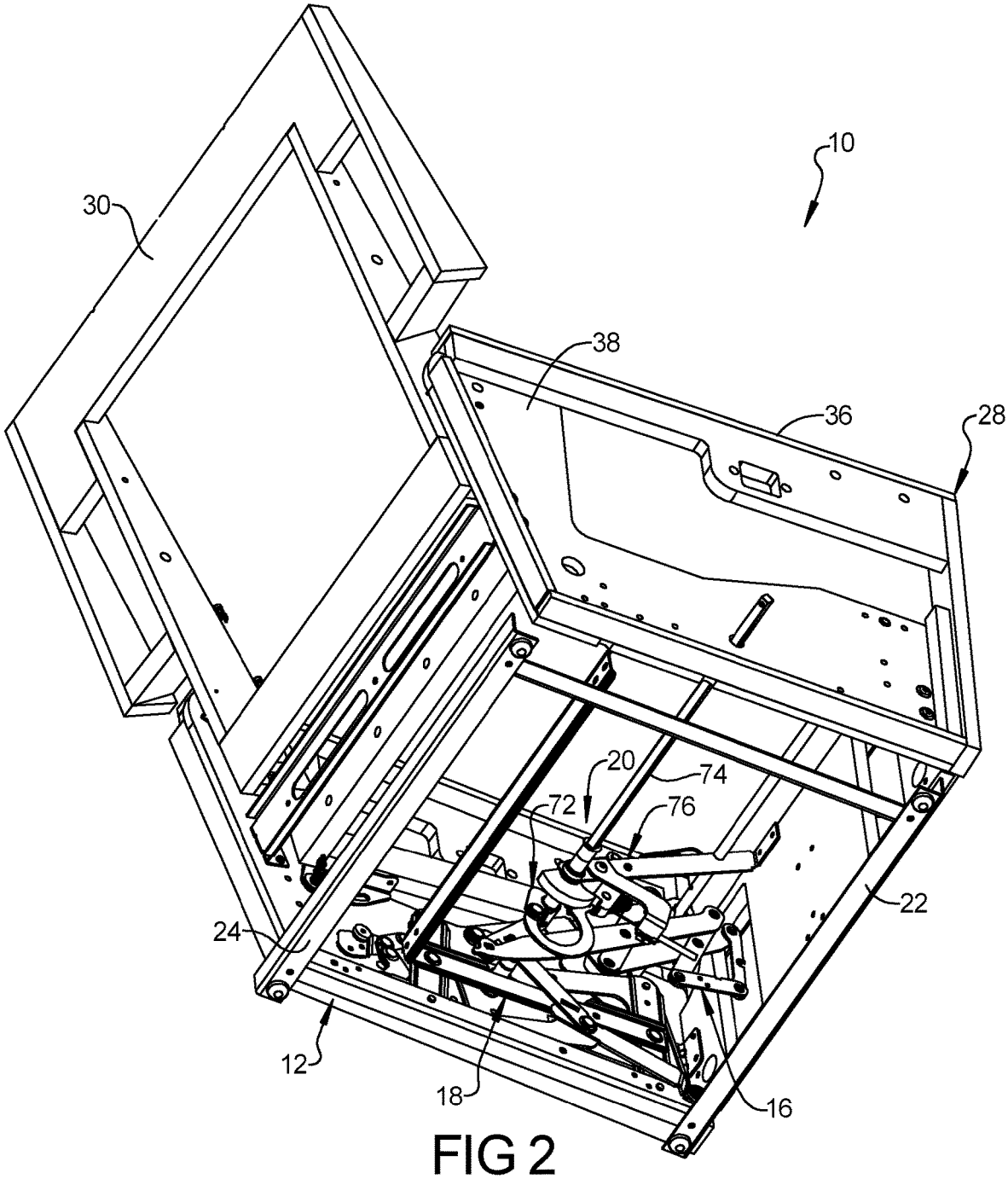
FIG. 2 is a bottom perspective view of the furniture member in the position of FIG. 1.
Figure 3:
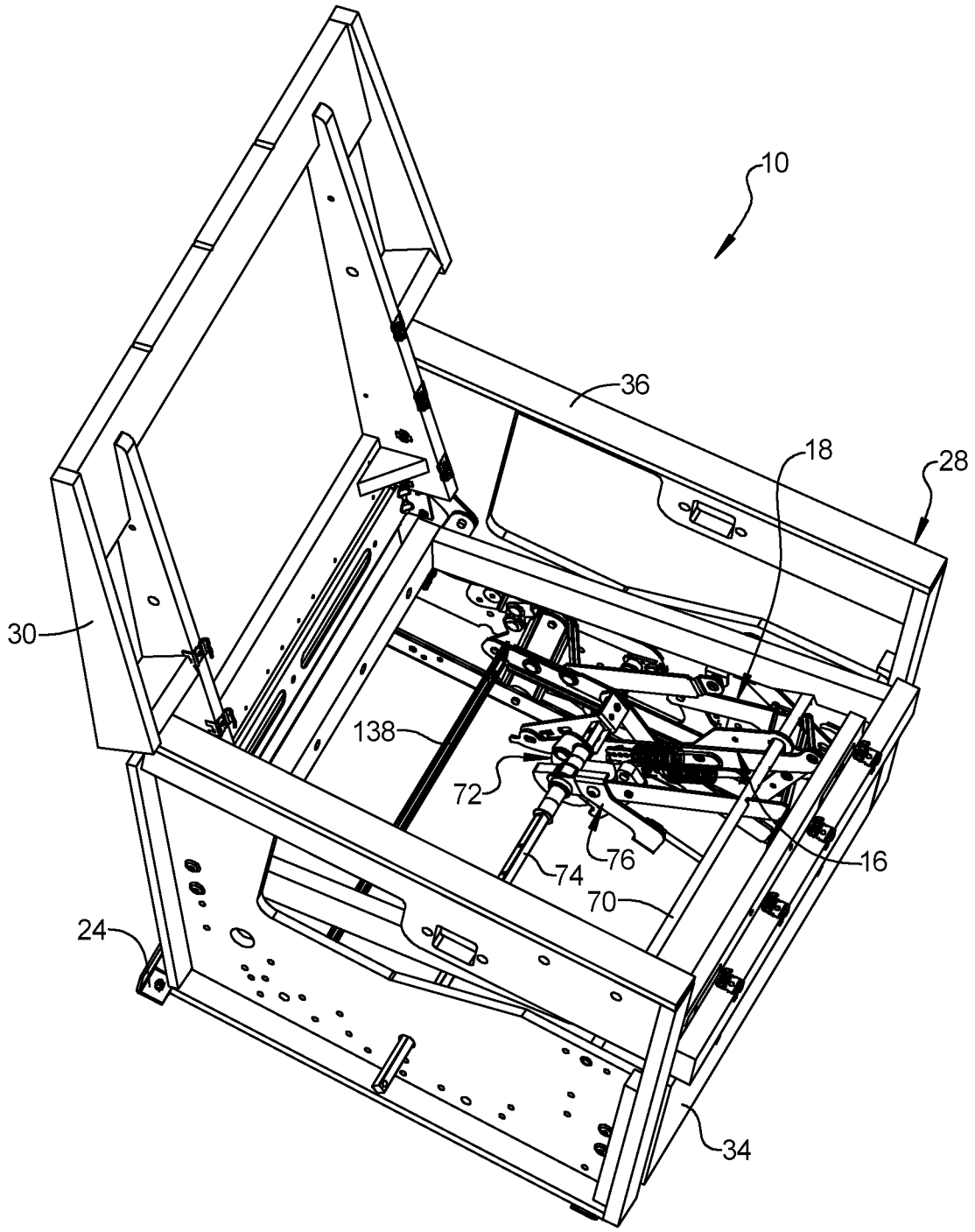
FIG. 3 is a top perspective view of the furniture member in the position of FIG. 1.

As shown in FIGS. 1 and 2, the base frame 12 may include a plurality of stationary beams including, for example, a front support member 22, a rear support member 24, and a pair of side support members 26. The side support members 26 are spaced apart from each other and are attached to and extend between the front and rear support members 22, 24.

As shown in FIGS. 1, 3, 10 and 17, the seat assembly 14 may include a seat frame 28, the seatback 30, a seat bottom 32, and a legrest platform 34. The seat frame 28 may include a plurality of armrests 36 and a seat base 38 that supports the seatback 30, the seat bottom 32 and the legrest mechanism 16. The seatback 30 is rotatably coupled to the seat base 38 to allow the seatback 30 to rotate between the fully upright and fully reclined positions.

Figure 4:
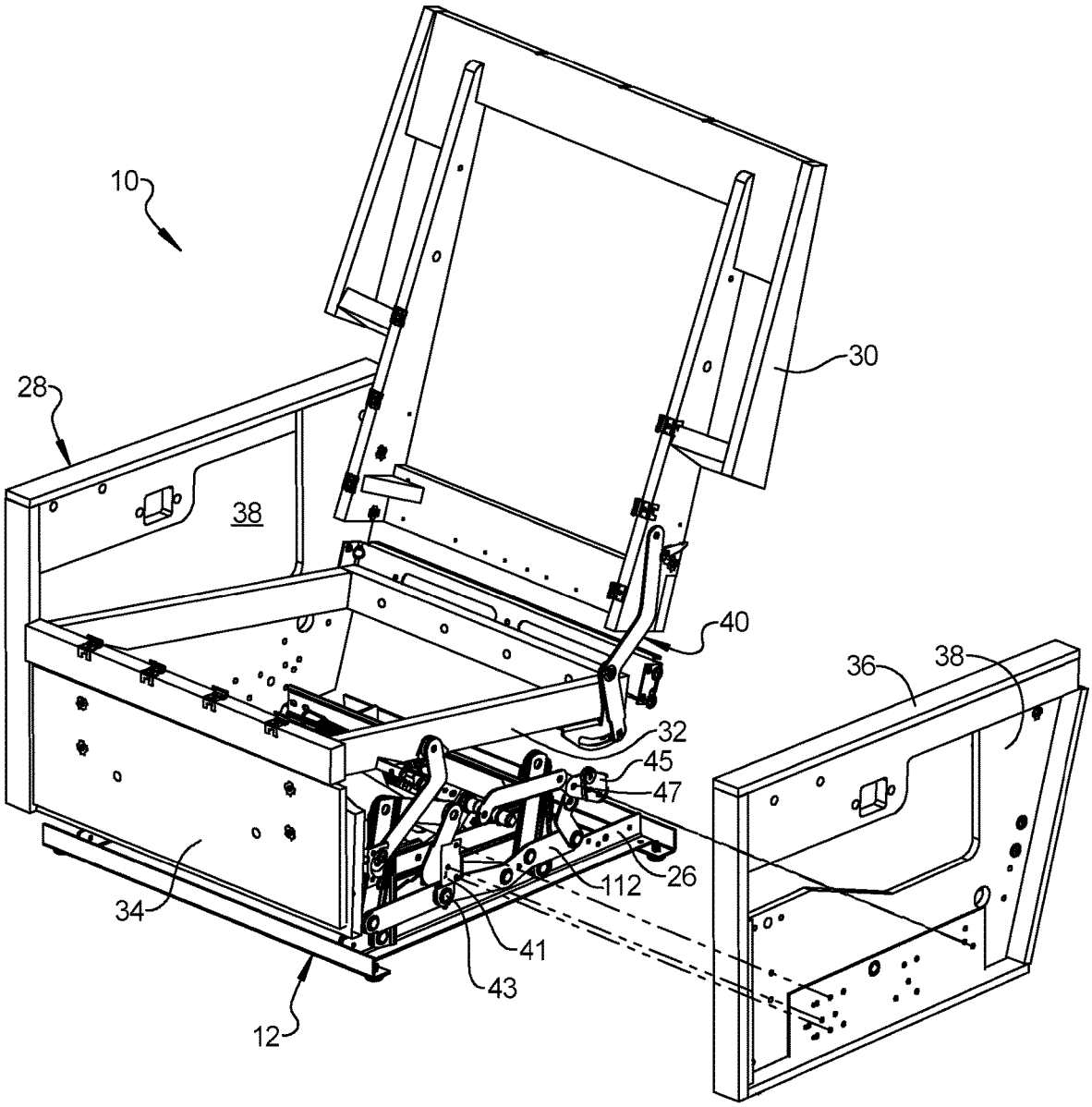
FIG. 4 is an exploded perspective view of the furniture member in the position of FIG. 1 showing the connection of a seat base to a wall-proximity mechanism.

As shown in FIG. 4, the seat base 38 can be connected to wall proximity mechanism 18 such that the seat base 38 translates relative to the base frame 12. The furniture member 10 can include a first seat base connection bracket 41 that can be rotatably connected to the wall-proximity mechanism 18 at a first connection point 43. The first connection point 43 is positioned in a second cross member 112 of the wall-proximity mechanism 18. The furniture member 10 can also include a second seat base connection bracket 45 that can be rotatably connected to the wall-proximity mechanism 18 at a second connection point 47. The second connection point 47 is positioned on a fourth connecting link 124. The seat base 38 is supported in position by the first seat base connection bracket 41 and the second seat base connection bracket 45. As will be further explained below, the weight of an occupant seated in the furniture member 10 is translated via the seat base 38 to the wall-proximity mechanism 18 and can urge the legrest platform 34 to move from the retracted position to the extended position when a drive rod 74 is rotated.

Figure 10:
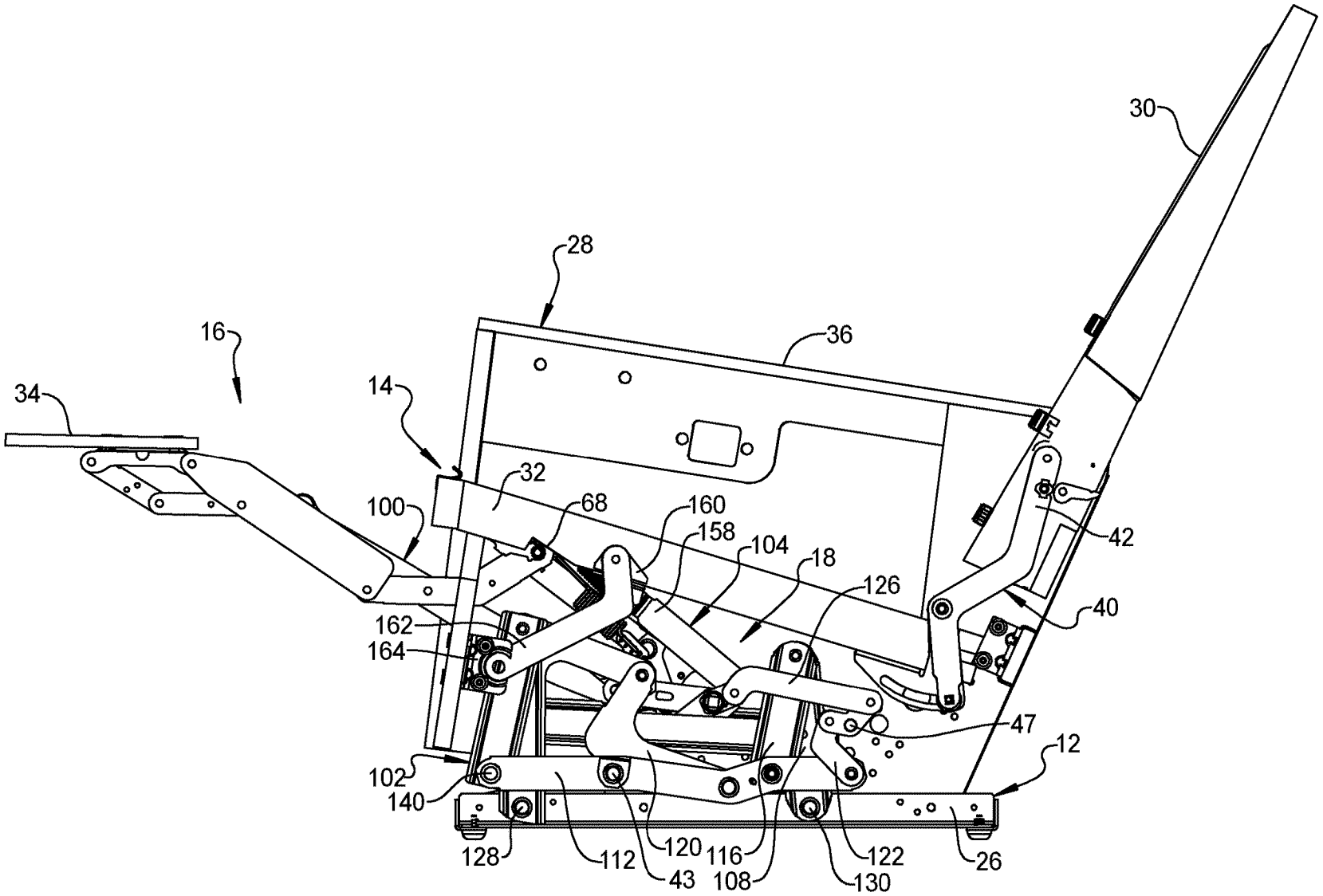
FIG. 10 is a side view of the furniture member with the seatback in the upright position and the legrest in an extended position according to principles of the present disclosure.

The seatback 30 is rotatably coupled to the seat bottom 32 by a pair of friction-slide mechanisms 40 (only one of which is shown in the figures). As shown in FIGS. 1, 10 and 17, each friction-slide mechanism 40 may include a lever 42 and a slide member 44. A first end 46 of the lever 42 may be fixedly attached to the seatback 30. An intermediate portion 48 of the lever 42 may be rotatably engaged with the slide member 44. A second end 50 of the lever 42 may include a protrusion 52 (e.g., pin, threaded fastener or rivet) that is slidably engaged with the slide member 44.

Figure 8:
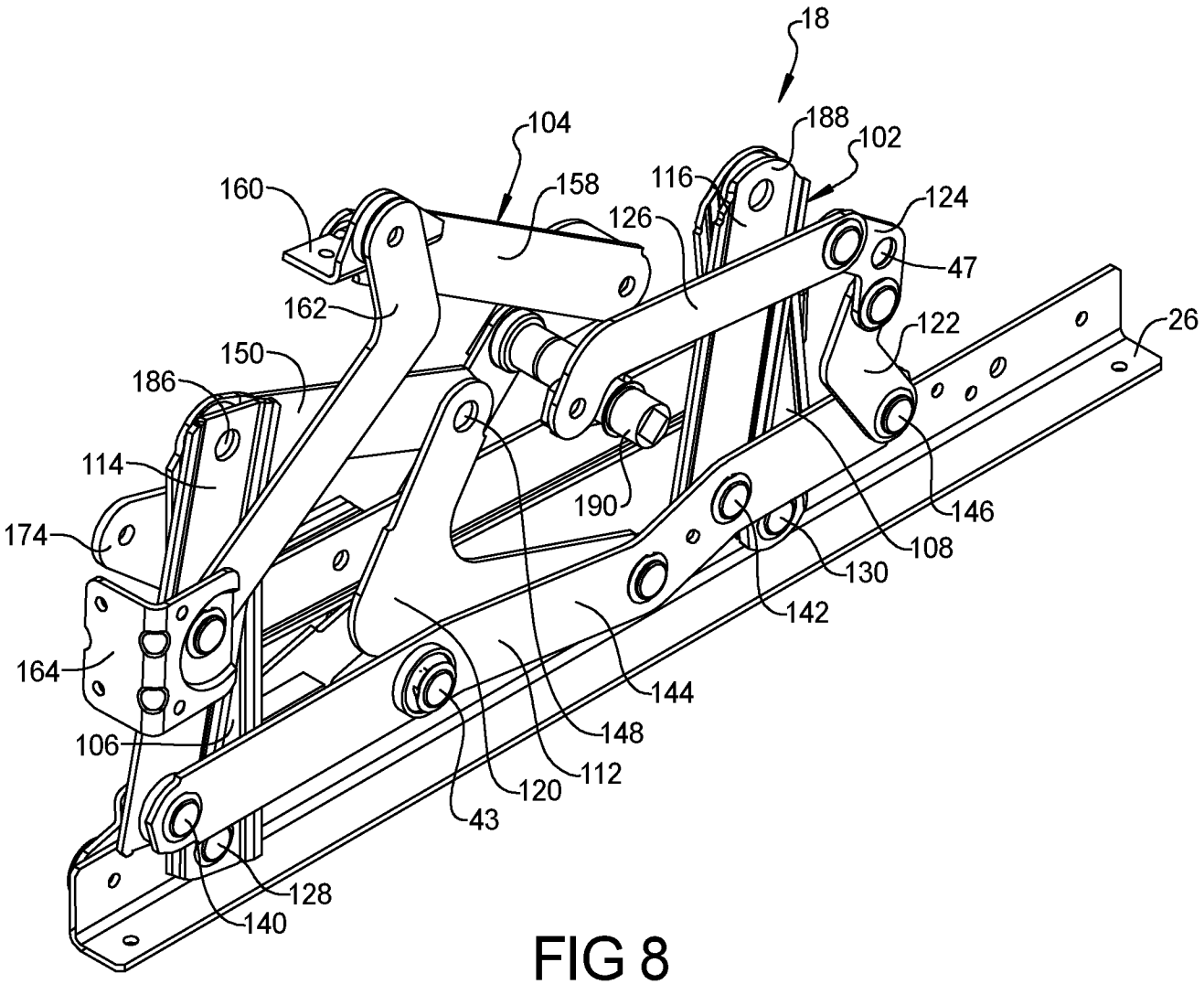
FIG. 8 is a perspective view of an opposite side of the wall-proximity mechanism of the furniture member when the furniture member is in the position of FIG. 1.
Figure 9:
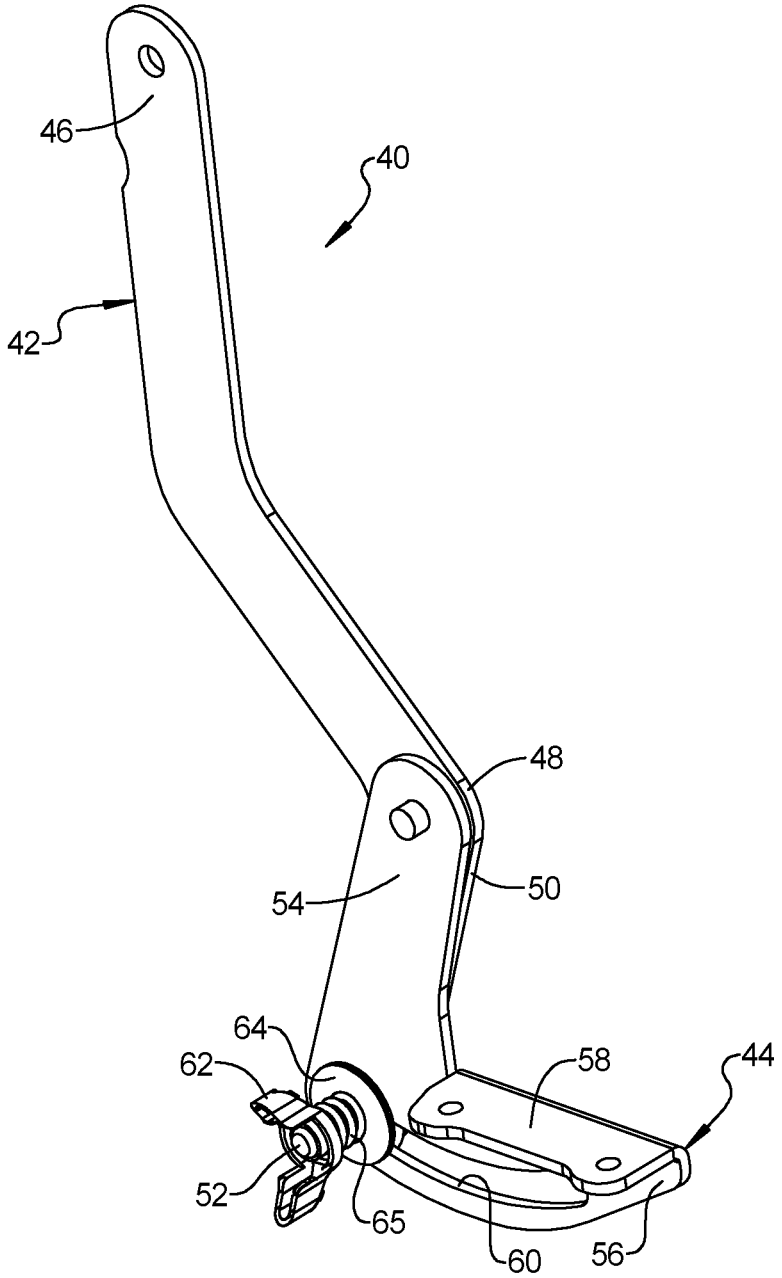
FIG. 9 is a perspective view of a friction-slide mechanism of the furniture member when the seatback is in the upright position.

As shown in FIG. 9, the slide member 44 may have first and second arms 54, 56 that cooperate to form a generally L-shaped member. The first arm 54 may be rotatably coupled with the intermediate portion 48 of the lever 42. The second arm 56 may include a flange 58 that may be fixedly attached to the seat bottom 32. The second arm 56 may include a curved slot 60 that slidably receives the protrusion 52 of the lever 42. As shown in FIG. 9, a nut 62 and washer 64 may engage the protrusion 52. Threadably tightening the nut 62 against the washer 64 may clamp the slide member 44 between the lever 42 and the nut 62. The tightness of nut 62 can be adjusted to adjust a frictional force between the lever 42 and the slide member 44. While the nut 62 shown in FIG. 8 is a wing nut, it can be appreciated that any type of nut could be used to adjust the frictional force between the lever 42 and the slide member 44. In some embodiments, a compression spring 65 may be disposed on the protrusion 52 between the nut 62 and the slide member 44 (or between the nut 62 and the washer 64). In such configurations, the tightness of the nut 62 could be adjusted to adjust the force of the spring urging the slide member 44 against the lever 42, thereby adjusting the frictional force between the lever 42 and the slide member 44. The frictional force can be adjusted according to the occupant's weight and size.

As shown in FIG. 1, the seat bottom 32, in this example, may include a notch 68 positioned forward of a pivot bracket 160. The notch 68 is a cut-out in the seat bottom 32 that provides clearance for a rod 70 that spans beneath the seat bottom 32.

Figure 11:
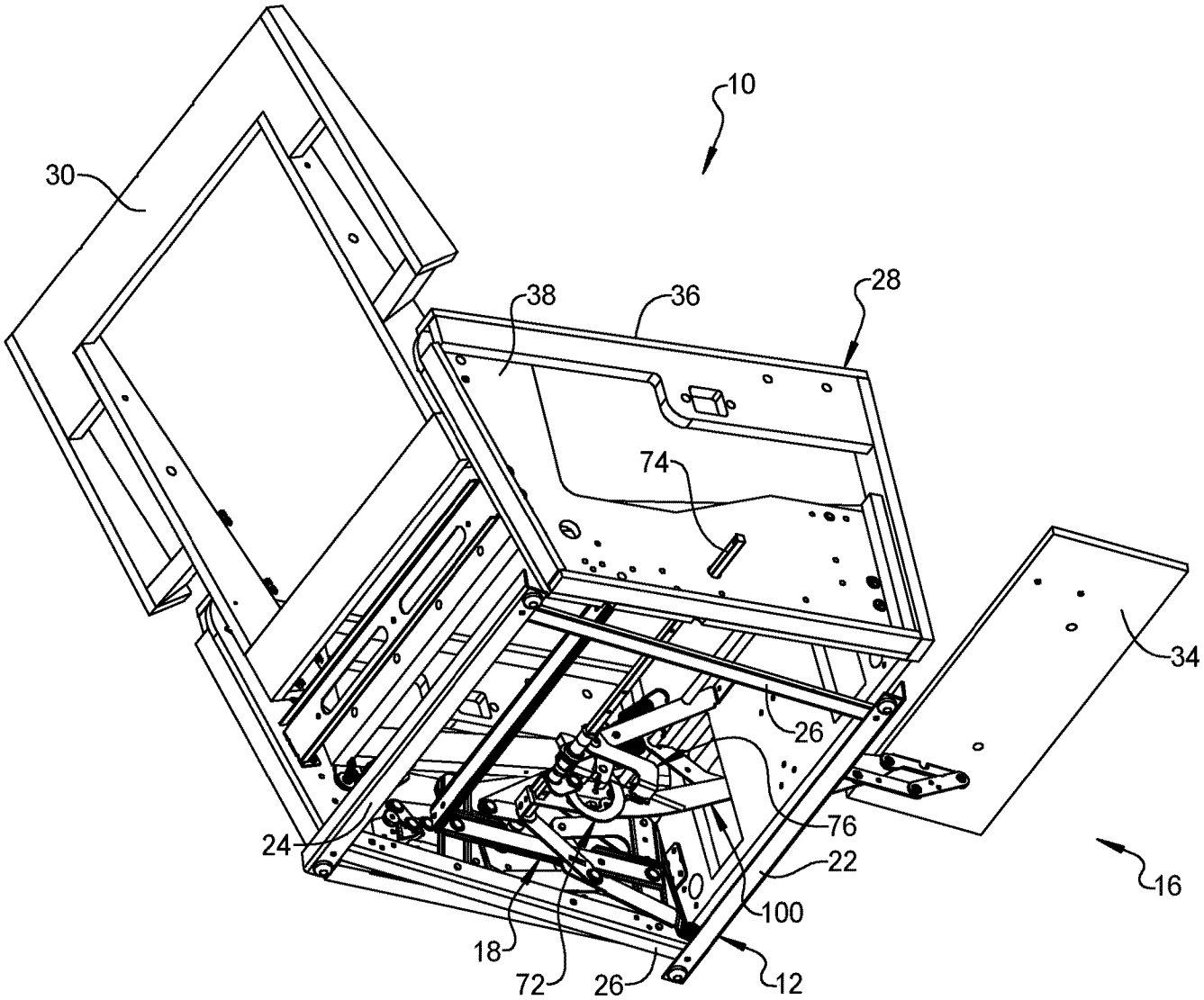
FIG. 11 is a bottom perspective view of the furniture member in the position of FIG. 9.
Figure 12:
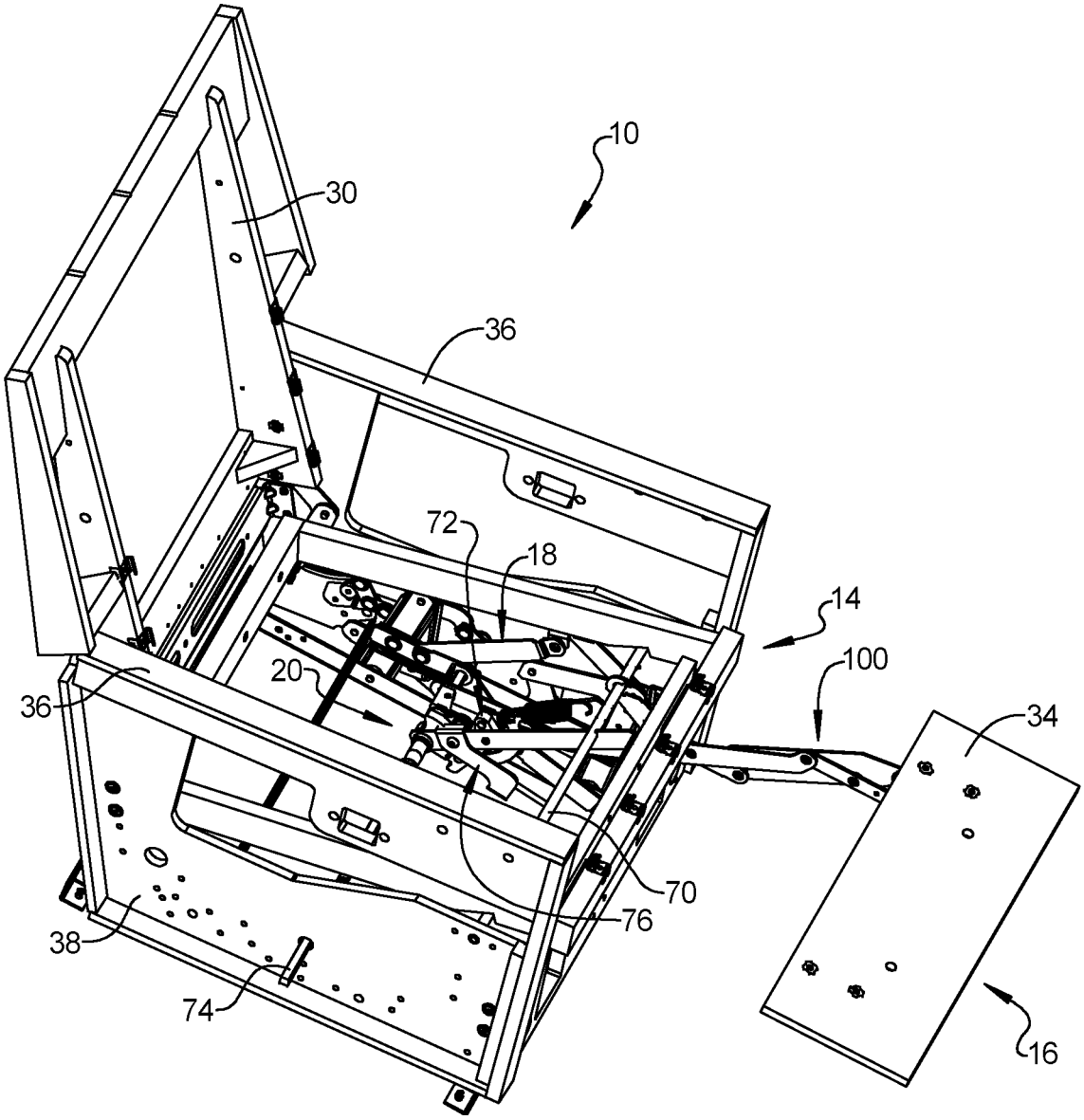
FIG. 12 is a top perspective view of the furniture member in the position of FIG. 9.
Figure 13:
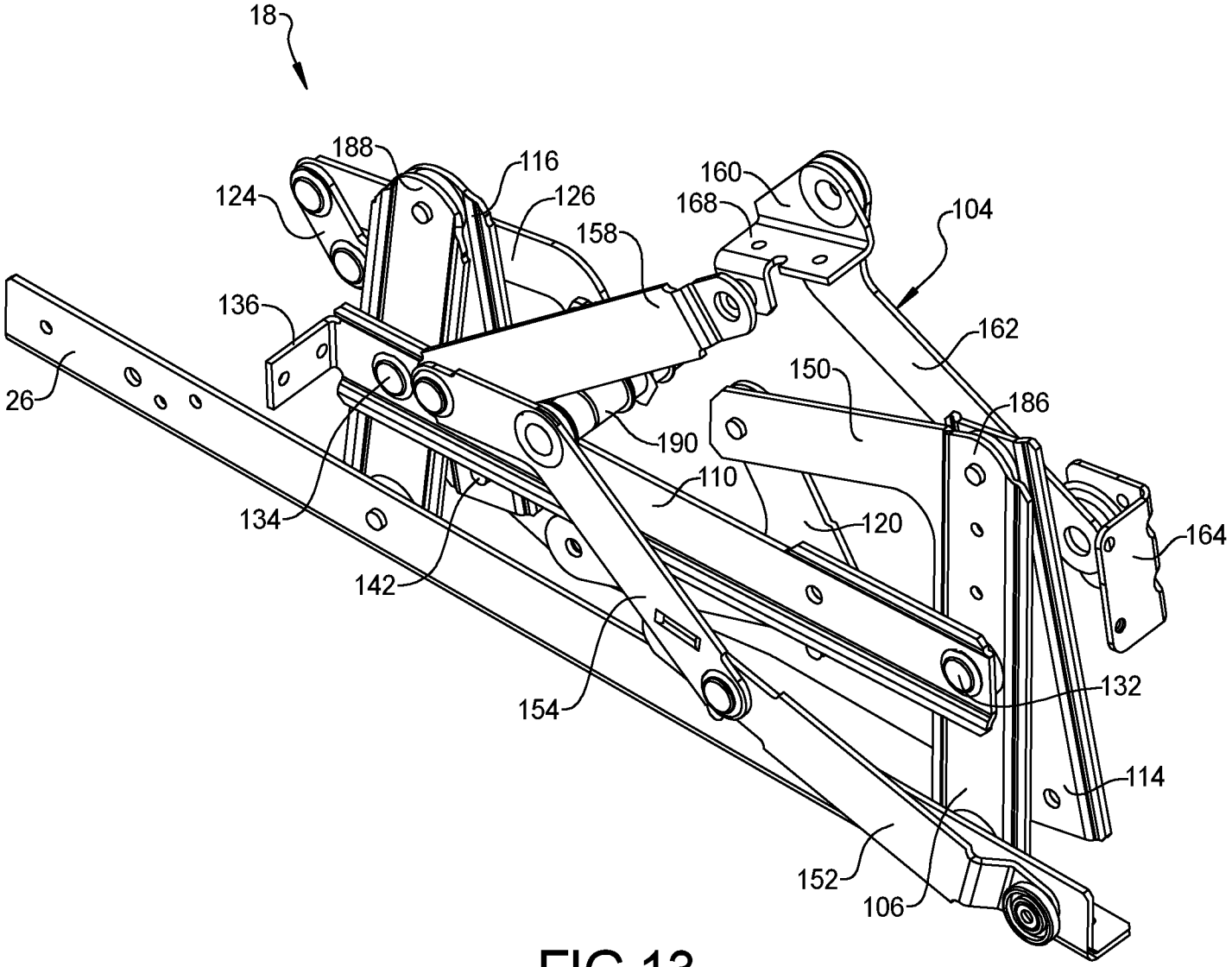
FIG. 13 is a perspective view of the wall-proximity mechanism of the furniture member when the furniture member is in the position of FIG. 9.
Figure 14:
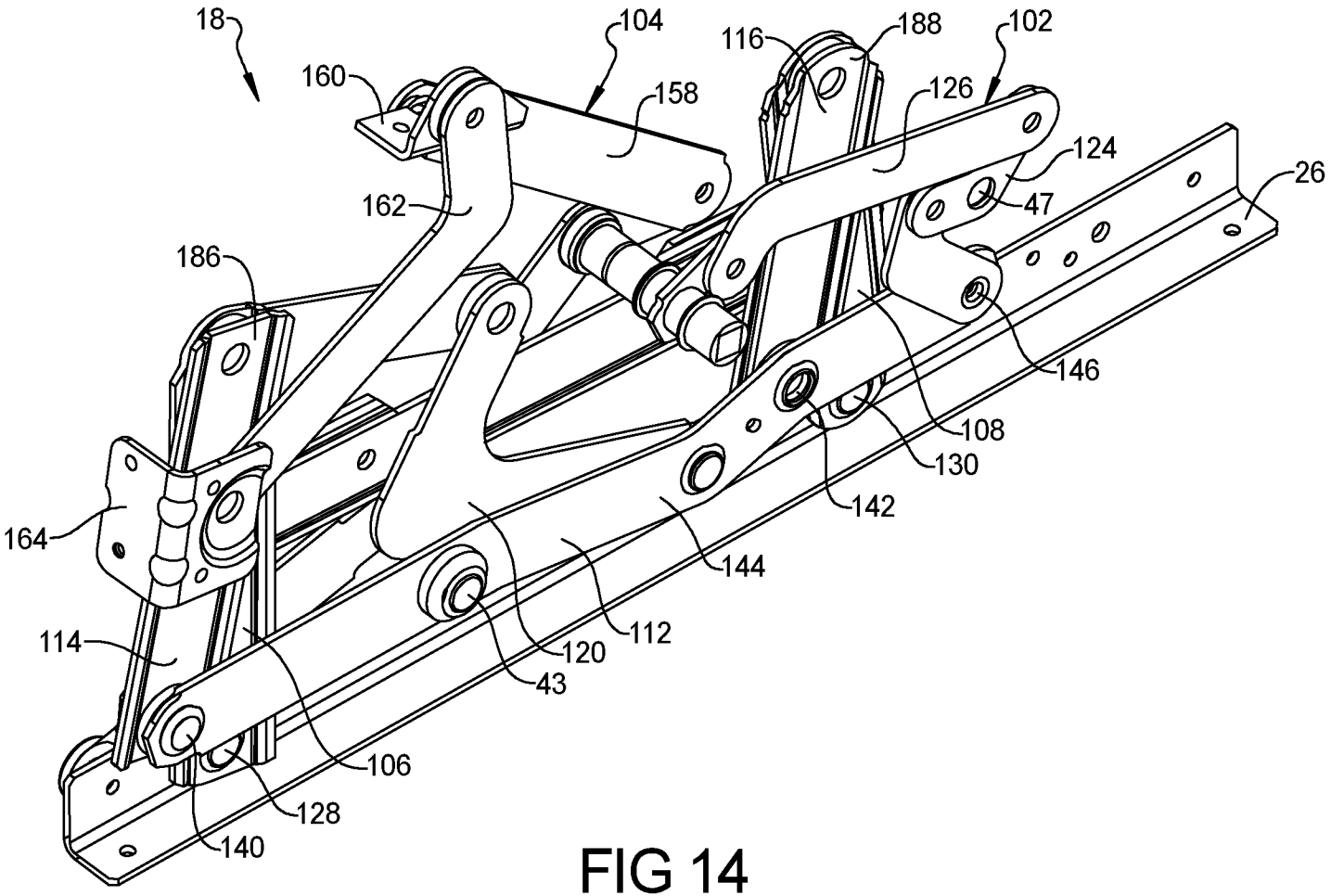
FIG. 14 is a perspective view of an opposite side of the wall-proximity mechanism of the furniture member when the furniture member is in the position of FIG. 9.

Referring now to FIGS. 2-5, the drive mechanism 20 includes the rod 70, a drive rod 74, a spring assist mechanism 72 and a trigger release mechanism 76. The furniture member 10 may include a pair of pantograph linkages 100 (only one of which is shown in the figures). The pantograph linkages 100 may be coupled to the rod 70, the legrest platform 34, and a drive rod 74. The drive rod 74 may be rotatably supported by the seat frame 28. When the drive rod 74 is rotated relative to the seat frame 28, the drive rod 74 drives the pantograph linkages 100 and legrest platform 34 between the retracted position (FIGS. 1-3) and the extended position (FIGS. 10-12). While not shown in the figures, a handle may be attached to an end of the drive rod 74 on an exterior side of the seat frame 28 so that an occupant seated in the furniture member 10 can grasp and rotate the handle to rotate the drive rod 74. In some configurations, the drive rod 74 may be attached to and driven by a drive motor (not shown). As will be described in more detail below, the drive rod 74 may be coupled to the wall-proximity mechanism 18 so that rotation of the drive rod 74 causes the wall-proximity mechanism 18 to tilt the seat assembly 14 relative to the base frame 12.

Figure 6:
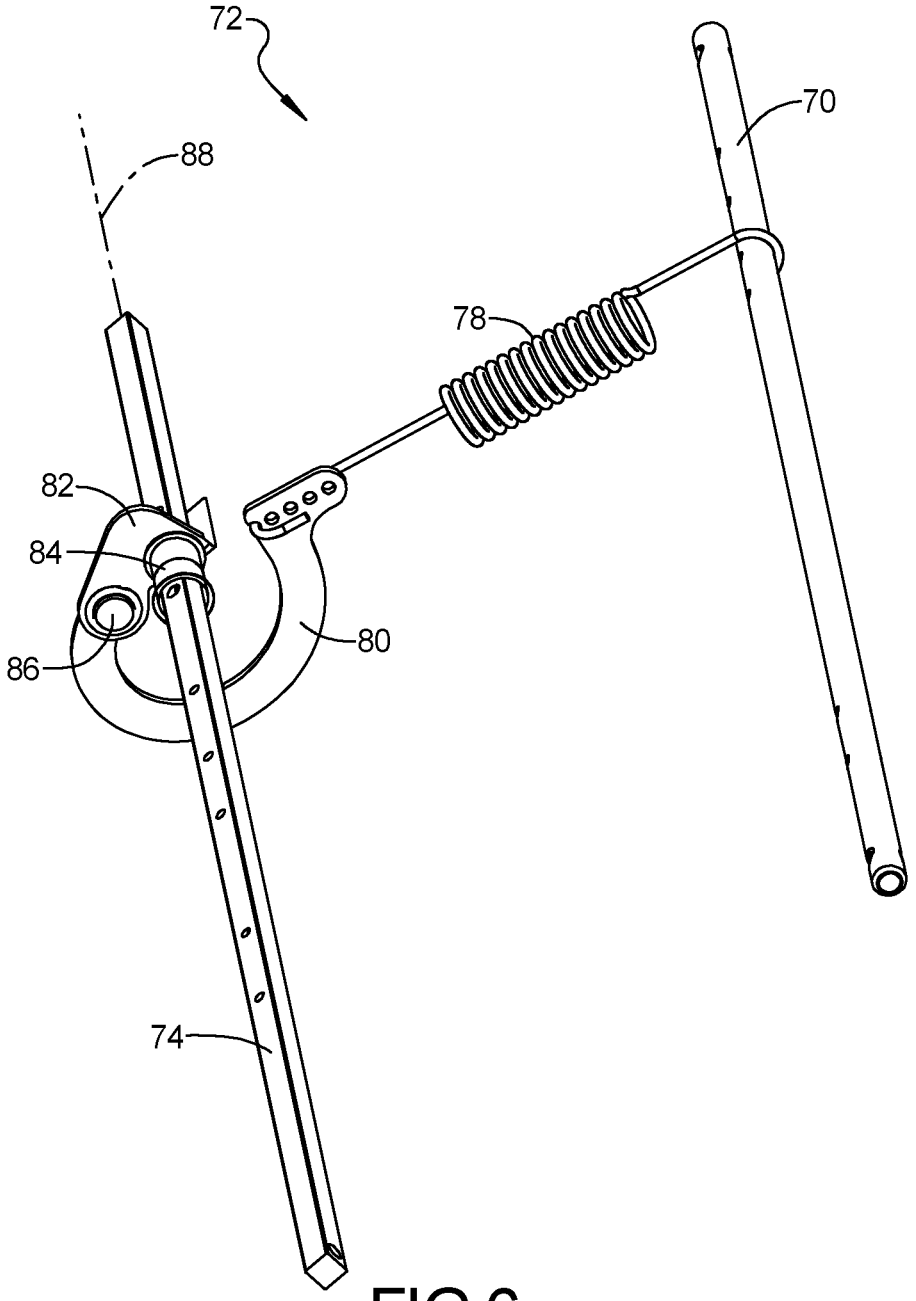
FIG. 6 is perspective view of a spring toggle mechanism of the furniture member when the furniture member is in the position of FIG. 1.

As shown in FIG. 6, the spring assist mechanism 72 is connected between the rod 70 and the drive rod 74. As discussed above, the rod 70 extends across the seat assembly 14 and is connected between the pair of pantograph linkages 100. The spring assist mechanism 72 exerts a force on the rod 70 to provide assistance against an occupant's body weight in activating the legrest mechanism 16. The spring assist mechanism 72 provides balance when the legrest mechanism 16 is moved from the retracted position to the extended position. The spring assist mechanism 72 exerts a torque on the drive rod 74 and thus to the pair of pantograph linkages 100 to counter the force that is exerted on the legrest mechanism by an occupant's legs when the legrest mechanism 16 is in the extended position.

In the example shown, the spring assist mechanism 72 may include a spring 78, a spring connector 80 and a spacing arm 82. The spring 78 extends between the rod 70 and the spring connector 80. The spring 78, in this example, is a coil spring. In other examples, other types of springs and/or biasing members can be used such as lengths of elastic materials or torsion springs. The spring 78 can be secured to the rod 70 by inserting an end of the spring through a hole in the rod 70. Similarly, the spring 78 can be connected to the spring connector 80 by inserting an opposite end of the spring 78 through a hole in the spring connector 80. As shown, the spring connector 80 can include a series of holes or slots to receive the end of the spring 78 such that different springs with different lengths and/or different spring rates can be used with the spring assist mechanism 72.

The spring connector 80, in this example, is a C-shaped link that is secured between the spring 78 and the spacing arm 82. The spring connector 80 is a rigid link and can be made of any suitable rigid material such as metal, plastic, composite or the like. The spring connector 80 has a curved portion that encircles a portion of the drive rod 74 before rotatably connecting to the spacing arm 82. In this configuration, the spring connector 80 permits the drive rod 74 to rotate during operation of the legrest mechanism 16 and/or the wall proximity mechanism 18. The spring connector 80 is spaced apart from the drive rod 74 a suitable distance to permit the spacing arm 82 to rotate with the drive rod 74.

The spacing arm 82, in the example shown, is a rigid link that is secured to the drive rod 74 and rotatably connected to the spring connector 80. The spacing arm 82 can have an inner profile that matches the outer profile of the drive rod 74. The spacing arm 82 can also include a tab that can be secured to the drive rod 74 with a fastener or other suitable connection method. In this manner, the spacing arm 82 rotates when the drive rod 74 rotates. The spacing arm 82 can be spaced apart from the trigger release mechanism 76 by the spacer 84. The spacer 84 is a sleeve of material received over the drive rod 74.

Figure 6A:
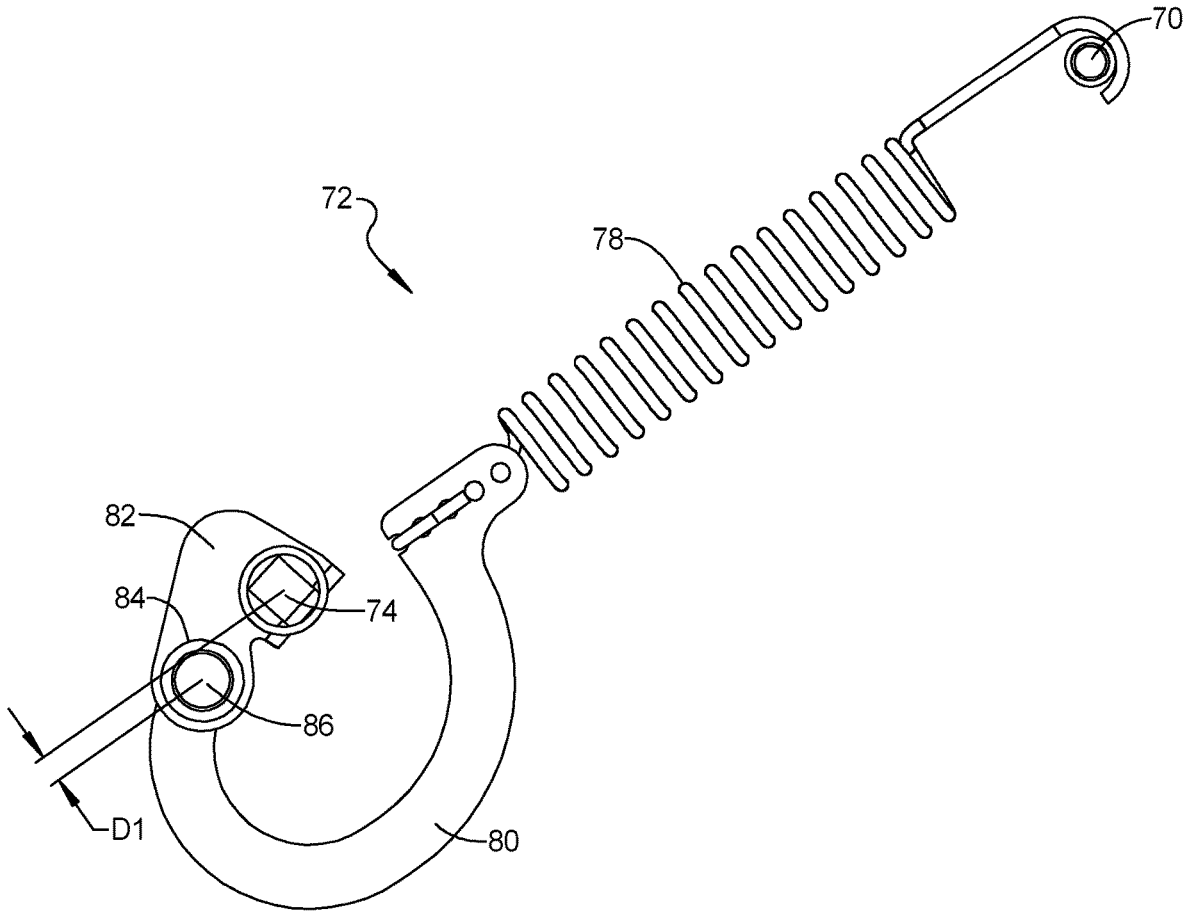
FIG. 6A is a magnified side view of the spring toggle mechanism of FIG. 5.
Figure 16:
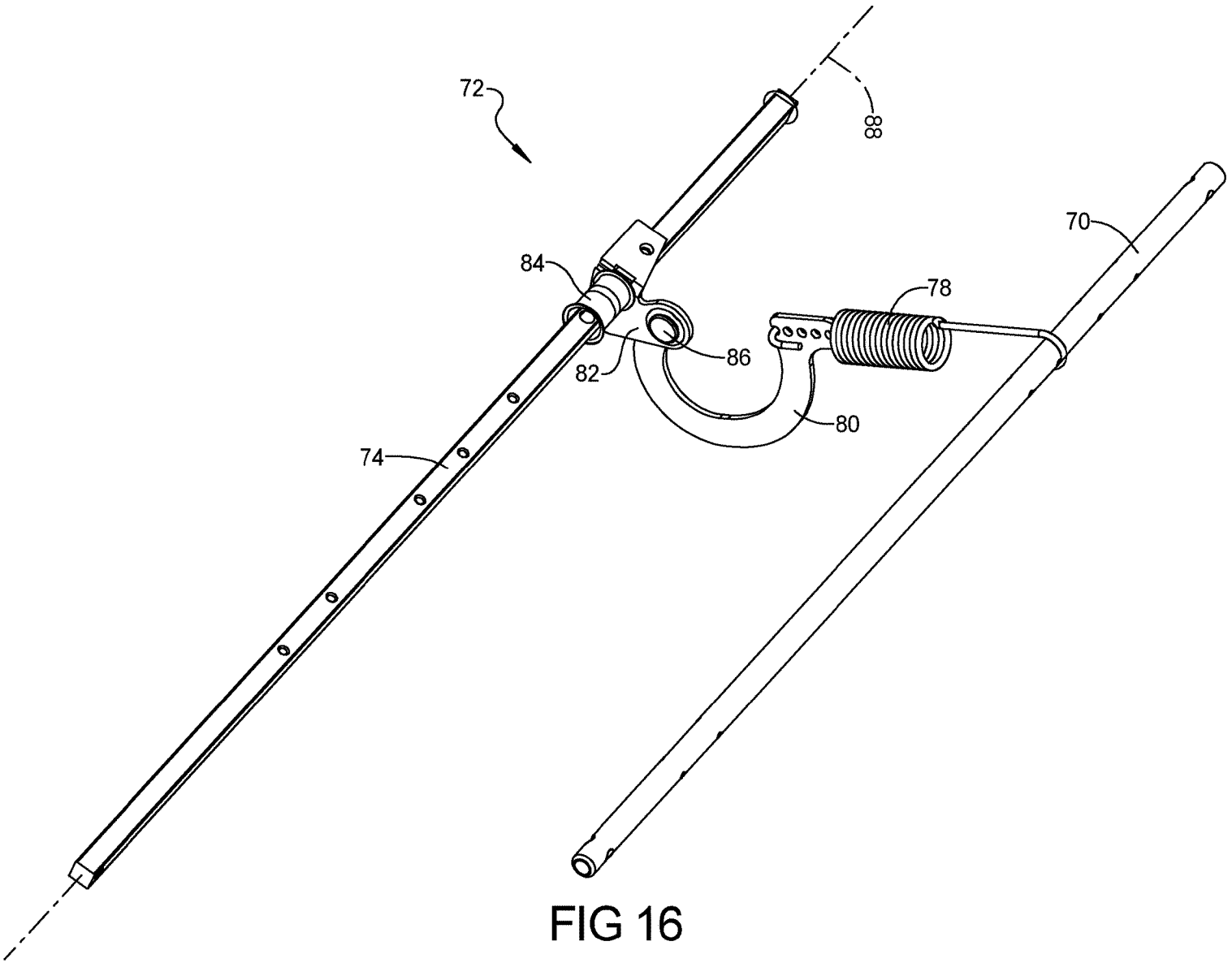
FIG. 16 is perspective view of a spring toggle mechanism of the furniture member when the furniture member is in the position of FIG. 9.
Figure 16A:
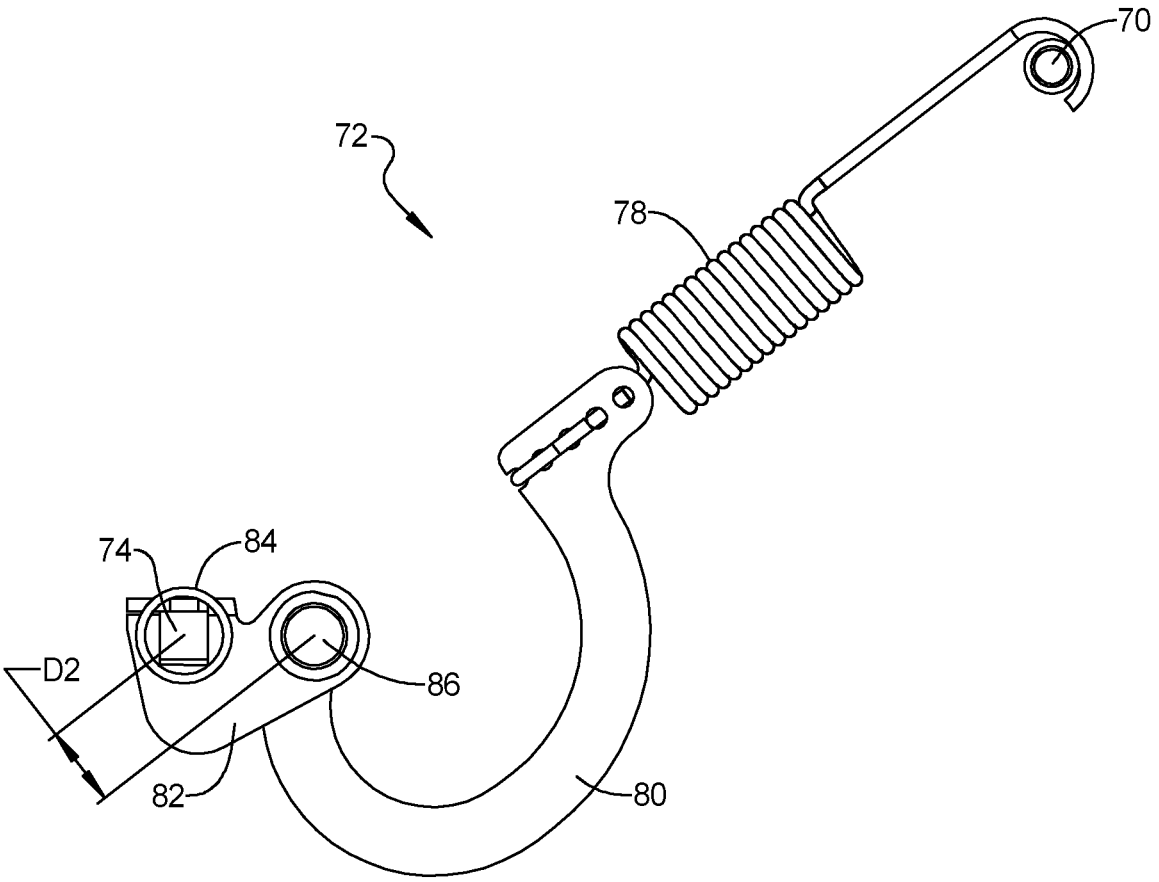
FIG. 16A is a magnified side view of the spring toggle mechanism of FIG. 15.

The spacing arm 82 is rotatably connected to the spring connector 80 at a connecting point 86. The spacing arm 82 separates the connecting point 86 from a center axis 88 of the drive rod 74. As shown in FIG. 6A, the connecting point 86 is located at a perpendicular distance D1 from the center axis 88. As can be appreciated, the force of the spring 78 that is pulling on the spring connector 80 and at the connecting point 86 urges the drive rod 74 to rotate about the center axis 88 with a torque proportional to a moment arm created by the distance D1. When the drive rod 74 rotates and causes the pair of pantograph linkages 100 to move from the retracted position to the extended position, the connecting point 86 moves closer to the rod 70 as shown in FIG. 16A. As this occurs, the spacing arm 82 rotates with the drive rod 74 and moves the connecting point 86 further away from the center axis 88 to a second distance D2. As can be seen, the distance D2 is greater than the distance D1. While the force exerted by the spring 78 when the legrest mechanism 16 is extended is less than the force exerted by the spring 78 when the legrest mechanism 16 is retracted because the spring 78 has a shorter length, the torque exerted on drive rod 74 can be maintained at a sufficient level to urge the drive rod 74 to move (or maintain) the legrest mechanism 16 in the extended position. This is accomplished by the larger moment arm caused by the spacing arm 82 increasing the distance of the connecting point 86 from D1 to D2. In various embodiments, the distances D1 and D2 can be adjusted as needed to cause the spring assist mechanism 72 to always bias the legrest mechanism 16 to the extended position so that the weight of the occupant's legs or the shifting of an occupant in the furniture member 10 does not result in an undesired retraction of the legrest mechanism 16.

Figure 5:
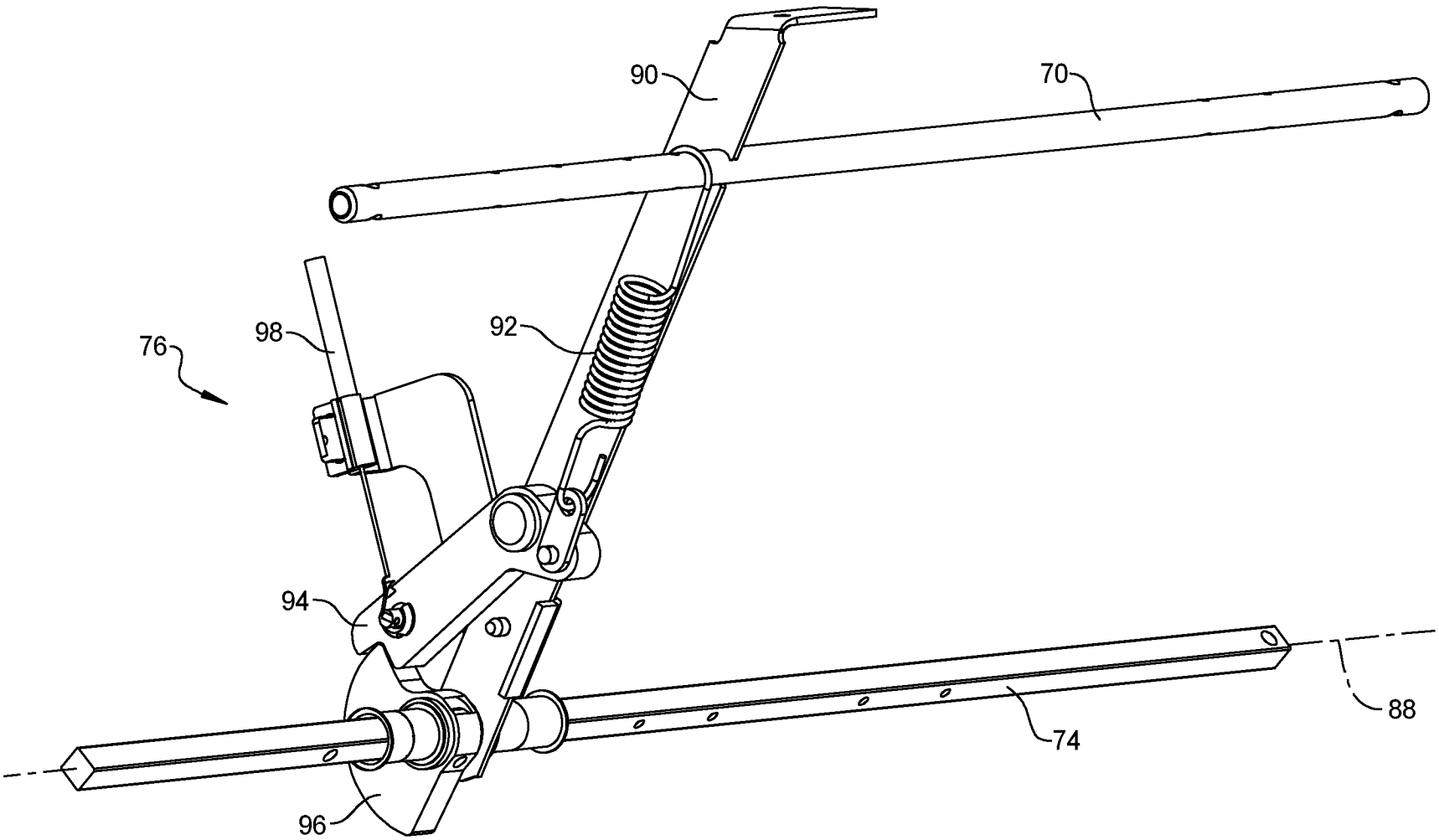
FIG. 5 is a perspective view of a trigger lock mechanism of the furniture member when the furniture member is in the position of FIG. 1.
Figure 15:
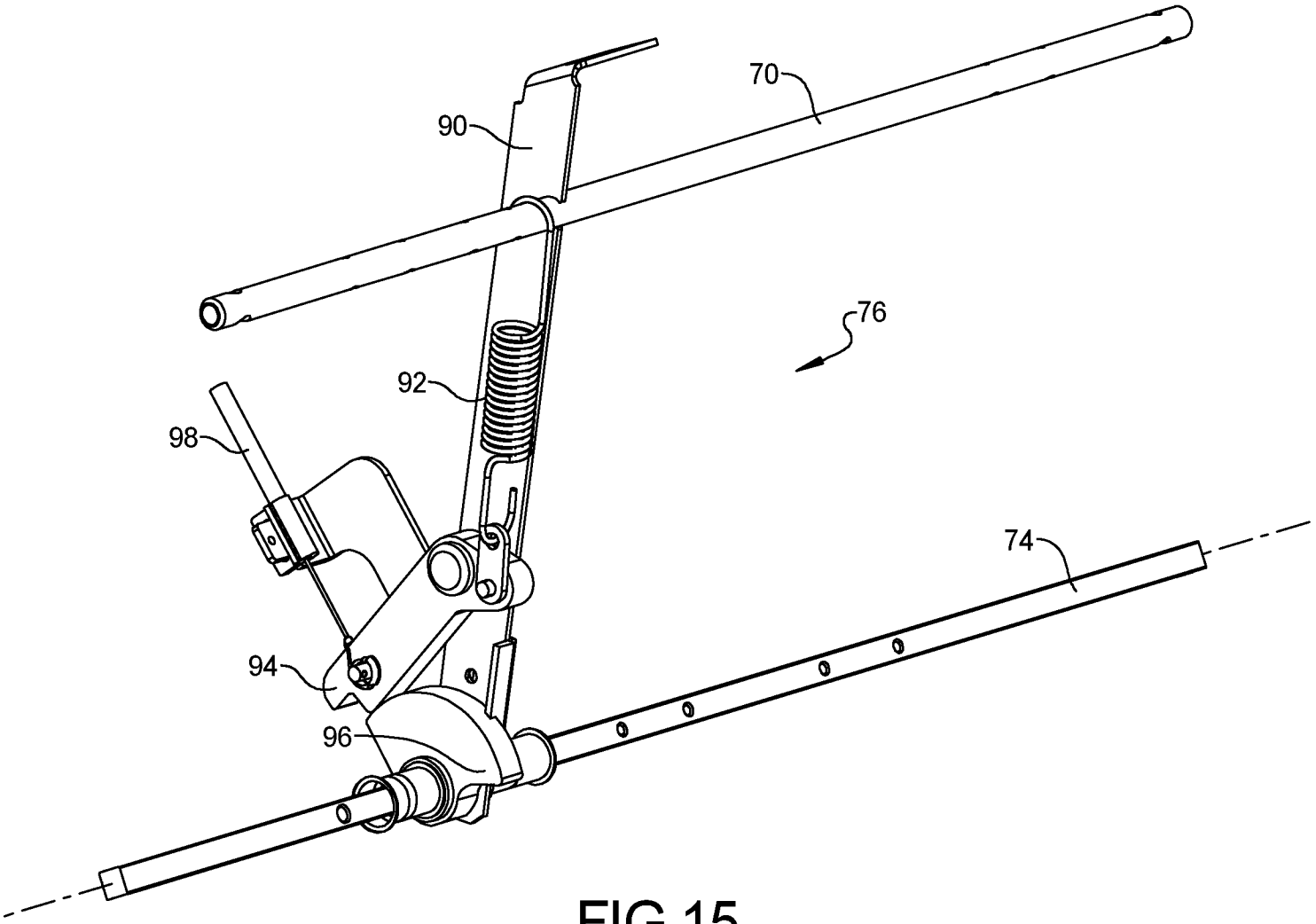
FIG. 15 is a perspective view of a trigger lock mechanism of the furniture member when the furniture member is in the position of FIG. 9.

The drive mechanism 20 may also include the trigger release mechanism 76. The trigger release mechanism 76 is connected to the drive rod 74 as shown in FIG. 5. The trigger release mechanism 76 can operate in a locked position (FIGS. 2-5) and in a released position (FIGS. 11, 12 and 15). In the locked position, the trigger release mechanism prevents rotation of the drive rod 74 such that the legrest mechanism 16 is not moved from the retracted position to the extended position unintentionally. In the released position, the trigger release mechanism 76 permits the drive rod 74 to rotate and cause the legrest mechanism 16 to move from the retracted position to the extended position. In some instances, a movement of the furniture member 10, such as a reclining movement of the seatback 30, can cause the legrest mechanism 16 to move the legrest platform 34 from the retracted position to the extended position prematurely. The trigger release mechanism 76 prevents such premature movement until the occupant moves the trigger release mechanism 76 from the locked position (FIG. 5) to the released position (FIG. 15).

The trigger release mechanism 76, in the example shown in FIG. 5, includes a support link 90, a biasing member 92, a trigger 94 and a cam 96. The support link 90 is connected to the drive rod 74 and a panel of the seat frame 28, such as a front panel positioned behind the legrest platform 34. The trigger 94 is rotatably connected to the support link 90 and is connected to the biasing member 92 that biases the trigger 94 against the cam 96. The biasing member 92, in this example, is a spring connected to an end of the trigger 94 and to the rod 70. In other examples, other types of biasing members 92 can be used.

The cam 96, in this example, is a rounded wedge shaped member that is connected to the drive rod 74. The cam 96 is connected to the drive rod 74 so that the cam 96 rotates when the drive rod 74 rotates. When the trigger release mechanism 76 is in the locked position (FIGS. 2-5), the trigger 94 engages the cam 96 as shown and the biasing member 92 urges the trigger 94 against the cam 96 to keep the trigger 94 engaged. As such, the cam 96 (and the drive rod 74) is limited from rotating to move the legrest mechanism 16 from the retracted position to the extended position.

As further shown in this example, the cable 98 is connected to the trigger 94. The cable 98 includes a wire that is movably received in a sleeve. The wire of the cable 98 can exert a force on the trigger 94 in a direction away from the cam 96. Thus, an occupant of the furniture member 10 can move the trigger 94 away from the cam 96 with the cable 98 to move the trigger release mechanism 76 from the locked position to the released position. When in the released position (FIGS. 11, 12 and 15), the trigger 94 is disengaged from the cam 96 and the cam 96 (with the drive rod 74) can rotate to move the legrest mechanism 16 from the retracted position to the extended position.

As shown in FIG. 15, the trigger 94 can rest on the outer rounded profile of the cam 96 as the drive rod 74 rotates to move the legrest mechanism 16 from the retracted position to the extended position. As can be appreciated, when the legrest mechanism 16 moves from the extended position to the retracted position, the cam 96 rotates in a reverse direction. As this occurs, the biasing member 92 is urging the trigger 94 against the cam 96. When the cam 96 returns to its position as shown in FIG. 5, the biasing member 92 causes the trigger 94 to engage the cam 96 and the trigger release mechanism is returned to the locked position.

While not shown, the cable 98 can be connected to a button, latch, lever, dial or other input device that is accessible to an occupant of the furniture member 10. As such, the input device can be actuated to move the trigger 94, as previously described, from the locked position to the released position. Such an input device can be positioned on one of the armrests 36 or the seat base 38, for example.

Figure 7:
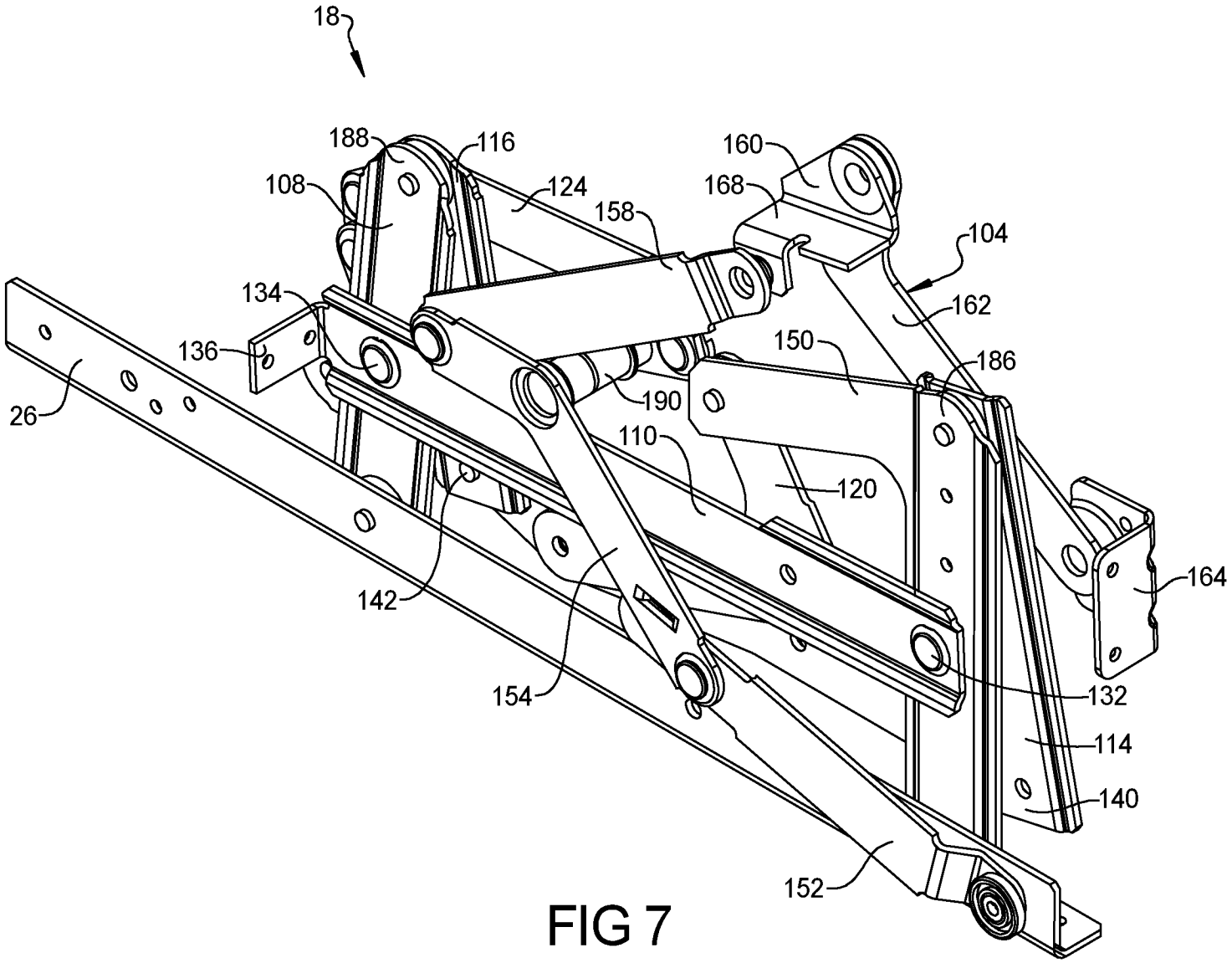
FIG. 7 is a perspective view of a wall-proximity mechanism of the furniture member when the furniture member is in the position of FIG. 1.

As previously described, the wall-proximity mechanism 18 may tilt the seat assembly 14 rearward relative to the base frame 12 and translate the seat assembly 14 forward relative to the base frame 12. The wall-proximity mechanism 18 may include a pair of first linkages 102 (only one of which is shown in the figures) and a pair of second linkages 104 (only one of which is shown in the figures). As shown in FIGS. 7 and 8, each of the first linkages 102 may include a first motion link 106, a second motion link 108, a first cross-member 110, a second cross-member 112, a first control link 114, a second control link 116, a first connecting link 118, a second connecting link 120, a third connecting link 122, a fourth connecting link 124, and a drive link 126.

In the example shown, first ends 128, 130 of the first motion link 106 and the second motion link 108, respectively, are pivotably mounted to the side support member 26. As such, the first motion link 106 and the second motion link 108 can rotate relative to the base frame 12. The first cross-member 110 is pivotably connected to an intermediate portion 132 of the first motion link 106 and to an intermediate portion 134 of the second motion link 108. An aft end 136 of the first cross-member 110 is connected to a transverse support bar 138. As shown in FIG. 2, the transverse support bar 138 spans across the furniture member 10 and connects the aft end 136 of the first cross-member 110 to an aft end of the first cross-member (not shown in the FIGs.) located on the opposite side of the furniture member 10.

The first control link 114 is rotatably connected to the first motion link 106 at a top end 186. The second control link 116 is rotatably connected to the second motion link 108 at a top end 188. The first control link 114 projects forward and downward from the top end 186 toward a second end 140. The second control link 116 projects forward and downward from the top end 188 toward a second end 142. The second end 140 of the first control link 114 and the second end 142 of the second control link 116 are connected to the second cross-member 112.

The second cross-member 112, in this example, is positioned laterally outboard of the first motion link 106, the second motion link 108, the first control link 114 and the second control link 116. The second connecting link 120 can also be connected to the second cross-member 112. In this example, the second connecting link 120 is rotatably connected to an intermediate portion 144 of the second cross-member 112 that is located between the second ends 140, 142 of the first control link 114 and the second control link 116. The second connecting link 120, in this example, has an L-shape. The second connecting link 120 projects away from the intermediate portion 144 of the second cross-member. The opposite end 148 of the second connecting link 120 is connected to an extension arm 150 of the first motion link 106.

The third connecting link 122 can also be connected to the second cross-member 112. As shown in FIG. 8, the third connecting link 122 is rotatably connected to the aft end 146 of the second cross-member 112. The fourth connecting link 124 is rotatably connected to the third connecting link 122. The drive link 126 is connected to the fourth connecting link 124. The drive link 126 is connected to a drive sleeve 190 that is connected to the drive rod 74. The drive sleeve 190 is positioned over the drive rod 74 and permits one or more of the elements of the first or second linkages 102, 104 to rotate independently of the drive rod 74 while translating with the wall proximity mechanism 18.

One or more mounting brackets can be connected to the pair of first linkages 102 to secure one or more elements of the seat assembly 14. Referring back to FIG. 4, the seat base 38 can be connected to the second cross-member 112 by the first seat base connecting bracket 41 at the first connection point 43. The seat base 38 can also be connected to the fourth connecting link 124 by the second seat base connecting bracket 45 at the second connection point 47. As shown, the first connection point 43 is positioned in a forward position on the second cross-member 112 (i.e., forward of the drive rod 74). The second connection point 47 is positioned in a rearward position on the wall-proximity mechanism 18 (i.e., rearward of the drive rod 74)

The pair of second linkages 104 (only one of which is shown in the figures) can include, in one example, a first swing link 152, a second swing link 154, a first pull link 158, a second pull link 162, a pull brace 164, and a pivot bracket 160. As shown in the example of FIGS. 7 and 8, the first swing link 152 can be rotatably connected to the side support member 26. The second swing link 154 can be rotatably connected to an opposite end of the first swing link 152. The second swing link 154 can extend between the first swing link 152 and the first pull link 158. As shown, the second swing link 154 is rotatably connected to the drive sleeve 190.

The drive sleeve 190 connects the second linkages 104 to the drive rod 74. As explained, the drive rod 74 translates forward when the wall-proximity mechanism 18 tilts the seat assembly 14 rearward relative to the base frame 12 and/or translates the seat assembly 14 forward relative to the base frame 12. The drive sleeve 190 is secured around the drive rod 74 and permits rotation of the drive rod 74 independently of the first linkages 102 and the second linkages 104.

The first pull link 158 can extend between the second swing link 154 and the pivot bracket 160. The first pull link 158, in this example, is rotatably connected to the drive bracket 156 and the pivot bracket 160. The second pull link 162 can extend between the pivot bracket 160 and the pull brace 164. In this example, the second pull link 162 is rotatably connected to the pivot bracket 160 and the pull brace 164.

The pivot bracket 160 can include a seat flange 168. The seat flange 168, in this example, is a planar surface on the pivot bracket 160 that can include one or more attachment points to which the seat bottom 32 can be attached. The pull brace 164, in the example shown, is an L-shaped bracket that can include one or more attachment surfaces that can be fixed to the seat frame 28. In the example shown, the pull brace 164 is connected to a front panel of the seat frame 28.

The links, brackets and/or braces of the first linkages 102 and the second linkages 104 can have any suitable cross-sectional profile. In some examples, the links, brackets and/or braces have continuous cross-sectional profiles. In other examples, the links, bracket and/or braces can have cross-sectional profiles that vary along their lengths. Some of the links, such as the first motion link 106, the second motion link 108, the first control link 114 and/or the second control link 116, have profiles with support ribs or support flanges that run down the edges of the links. Such ribs or support flanges can increase the bending strength of the link over that of a link having a flat or straight cross-sectional profile. In addition, a cross-sectional profile with a support rib and/or a support flange along one or both edges of the link can create a cup-shaped profile to provide clearance for a bushing or other friction-reducing element to be positioned in the profile between the link and an adjacent link that is rotatably connected thereto.

The links, brackets and/or braces of the first linkages 102 and the second linkages 104 can be connected to one another using any suitable connection method. In some examples, the links, brackets and/or braces that are described as fixedly connected to one another are joined using fasteners such as rivets, screws, bolts. The links, brackets and/or braces that are fixedly connected to one another can also be joined using other connection methods such as welding, staking or the like. In instances in which the links, brackets and/or braces are described as being rotatably connected to one another, the links, brackets and/or braces can be joined using any suitable connecting structure that permits the joined components to rotate relative to one another about the point of connection.

In one example, the rotatably connected links, brackets and/or braces can be joined using a rotatable joint assembly. Such a joint assembly can include a bushing, a grommet and a rivet or other fastener. The grommet is inserted into an opening on the link, bracket and/or brace and the bushing is placed between the adjacent links, brackets and/or braces. The rivet (or other fastener) is then inserted through the adjacent links, brackets and/or braces and through the grommet and the bushing to create a low-friction rotatable joint. In other examples, other rotatably joint assemblies can be used.

With reference to FIGS. 1-22, the operation of the furniture member 10 will be described. As explained above, the pantograph linkages 100 move the legrest platform 34 from the retracted position (FIGS. 1-3) to the extended position (FIGS. 10-12). The drive rod 74 is rotated by the occupant (using a lever in one example) driving the pantograph linkages 100 to extend the legrest platform 34. As this action occurs, the wall-proximity mechanism 18 stays largely unchanged.

When the drive rod 74 is rotated by an occupant, the weight of the occupant in the seat base 38 pivots around the first connection point 43 and a force is exerted at the second connection point 47 on the fourth connecting link 124. As this occurs, the force at the second connection point 47 urges the fourth connecting link 124 to move downward pulling the drive link 126 rearward. This movement urges the legrest platform to move from the retracted position (FIGS. 1-3) to the extended position (FIGS. 10-12). Thusly, the weight of an occupant of the furniture member 10 is advantageously used to assist in extending the legrest platform 34.

As discussed, in order to permit the drive rod 74 to rotate, an occupant would need to move the trigger release mechanism 76 from the locked position to the released position. An occupant can cause this to occur by actuating the user input device (e.g., button, lever or dial) connected to the cable 98. This action causes the trigger 94 to move away from the cam 96 to permit the drive rod 74 to rotate.

The furniture member 10, after the legrest platform 34 has moved from the retracted position to the extended position, can move further such that the seatback 30 moves from the upright position to the reclined position and the seat frame can tilt rearward and translate forward. This positioning of the furniture member 10 is depicted in FIGS. 17-19. The wall-proximity mechanism 18 drives both the seat bottom 32 and the seat frame 28 forward.

As previously described, the drive sleeve 190 is connected to the second linkage 104 via the second swing link 154. As the seat bottom 32 translates forward the pivot bracket 160 moves forward. The drive sleeve 190 is also pulled forward.

The drive sleeve 190, in the example shown, is also connected to the first linkage 102 via the drive link 126. As the drive rod 74 translates forward, the drive link 126 pulls the fourth connecting link 124 and the third connecting link 122. This movement pulls the second cross-member 112 forward. As the second cross-member 112 moves forward, the first control link 114 and the second control link 116 (and the first motion link 106 and the second motion link 108) rotate to cause the seat frame 28 to translate forward and tilt rearward as shown in FIG. 17.

As can be appreciated, the furniture member 10 can operate in the in a reverse manner to that previously described to return the furniture member 10 to its original positioning.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame;

a seat assembly supported by the base frame and including a seat frame, a seat bottom, a seatback and a legrest, the legrest movable relative to the base frame and seat frame between a retracted position and an extended position, the seatback movable relative to the base frame and seat frame between an upright position and a reclined position;

a drive rod rotatably mounted to the seat frame;

a legrest mechanism attached to the legrest and driven by the drive rod such that the legrest mechanism is configured to move the legrest between the retracted and extended positions in response to rotation of the drive rod;

a wall-proximity mechanism connected to the base frame and the seat assembly and configured to move the seat frame forward relative to the base frame; and a trigger release mechanism connected to the seat frame and the drive rod, the trigger release mechanism operable between a locked position in which a trigger limits rotation of the drive rod and a released position in which the trigger permits rotation of the drive rod.

2. The furniture member of claim 1, wherein the trigger release mechanism includes a cam connected to the drive rod, wherein the trigger engages the cam in the locked position to limit rotation of the drive rod and rotates away from the cam to disengage the cam in the released position to permit rotation of the drive rod.

3. The furniture member of claim 2, wherein the trigger release mechanism further includes a biasing member, wherein the biasing member biases the trigger against the cam, and wherein the trigger release mechanism prevents the legrest from moving from the retracted position to the extended position when the trigger release mechanism is in the locked position.

4. The furniture member of claim 3, wherein the trigger release mechanism further includes a cable connected to the trigger, wherein the cable is operable to rotate the trigger away from the cam in response to an input by an occupant of the furniture member, and wherein the trigger engages the cam to move the trigger release mechanism to the locked position when the legrest is moved from the extended position to the retracted position.

5. The furniture member of claim 1, further comprising a spring assist mechanism operable to urge the legrest mechanism to move the legrest from the retracted position to the extended position.

6. The furniture member of claim 5, wherein the spring assist mechanism includes a spring, a spring connector and a spacing arm, the spring connector connected between the spring and the spacing arm, the spacing arm connected to the drive rod whereby the spring exerts a force on the spacing arm to urge the drive rod to rotate.

7. The furniture member of claim 6, wherein the spring connector is connected to the spacing arm at a connection point, the connection point offset from a center axis of the drive rod by a distance that changes as the drive rod rotates to vary a moment arm at which a force exerted by the spring pulls on the spacing arm to urge the drive rod to rotate.

8. The furniture member of claim 7, wherein the spring connector has a rounded shape that curves around the drive rod, the spring connector spaced apart from the drive rod to permit the spacing arm to rotate with the drive rod.

9. The furniture member of claim 8, wherein the distance that the connection point is offset from the center axis of the drive rod becomes larger when the drive rod rotates to move the legrest from the retracted position to the extended position.

10. The furniture member of claim 1, wherein:

the wall-proximity mechanism includes a first linkage connected to the drive rod, the first linkage including a first motion link and a second motion link, the first motion link and the second motion link are rotatably connected to a first cross-member and to the base frame, the first motion link is rotatably connected to a first control link on an end opposite to the base frame, the second motion link is rotatably connected to a second control link on an end opposite to the base frame, the first control link and the second control link are rotatably connected to a second cross-member, and the first cross-member and the second cross-member are configured to move substantially parallel to one another to translate the seat frame forward relative to the base frame.

11. The furniture member of claim 10, wherein:

the wall-proximity mechanism includes a second linkage connected to the drive rod, the second linkage includes a first swing link, a second swing link, a first pull link, a second pull link and a pivot bracket, the first swing link is rotatably connected to the base frame at one end and to the second swing link at the opposite end, the second swing link is rotatably connected to the drive rod, the pivot bracket is connected to the seat bottom and to the first pull link and to the second pull link, the second pull link is connected to the seat frame, and the second linkage is configured to translate the seat bottom forward relative to the seat frame.

12. A furniture member comprising:

a base frame;

a seat assembly supported by the base frame and including a seat frame, a seat bottom, a seatback and a legrest;

a drive rod rotatably mounted to the seat frame;

a pair of legrest mechanisms mounted laterally outboard of and connected to the drive rod, the pair of legrest mechanisms each including a pantograph linkage configured to move the legrest from a retracted position to an extended position in response to rotation of the drive rod;

a pair of wall-proximity mechanisms mounted laterally outboard of the pair of legrest mechanisms, the pair of wall-proximity mechanisms connected to the drive rod and each including a first linkage connected to the base frame and the seat frame and a second linkage connected to the first linkage and the seat bottom, the first linkage configured to move the seat frame forward and the second linkage configured to move the seat bottom forward;

a trigger release mechanism connected to the seat frame and the drive rod, the trigger release mechanism operable between a locked position in which a trigger limits rotation of the drive rod and a released position in which the trigger permits rotation of the drive rod; and a spring assist mechanism connected to the drive rod and operable to urge the pair of legrest mechanisms to move the legrest from the retracted position to the extended position, wherein the trigger release mechanism is connected to the seat frame and the drive rod between the pair of legrest mechanisms and between the pair of wall-proximity mechanisms, wherein the trigger is rotatably supported relative to the seat frame by a support link spanning between the drive rod and the seat frame, wherein the trigger release mechanism further includes a cam connected to the drive rod adjacent to the trigger, wherein the trigger rotates to engage and disengage the cam to move the trigger release mechanism from the locked position to the released position, wherein the spring assist mechanism is connected to the drive rod and includes a spring, a spring connector and a spacing arm, wherein the spacing arm is connected to the drive rod such that the spacing arm rotates with the drive rod around a center axis, wherein the spacing arm is connected to the spring connector at a connection point, wherein the connection point is offset from the center axis such that a force exerted by the spring at the connection point urges the drive rod to rotate, wherein the spring is connected to the spring connector on a second end of the spring connector opposite to the connection point, and wherein the spring connector has a curved shape between the second end and the connection point.

13. A furniture member comprising:

a base frame;

a seat assembly supported by the base frame and including a seat frame, a seat bottom, a seatback and a legrest, the legrest movable relative to the base frame and seat frame between a retracted position and an extended position;

a drive rod rotatably mounted to the seat frame;

a legrest mechanism attached to the legrest and the seat frame and driven by the drive rod, the legrest mechanism configured to move the legrest between the retracted and extended positions in response to rotation of the drive rod;

a spring assist mechanism connected to the drive rod and operable to urge rotation of the drive rod in a direction to cause the legrest mechanism to move the legrest from the retracted position to the extended position; and a trigger release mechanism connected to the seat frame and the drive rod, the trigger release mechanism operable between a locked position in which a trigger limits rotation of the drive rod and a released position in which the trigger permits rotation of the drive rod.

14. The furniture member of claim 13, wherein the spring assist mechanism includes a spring and a spacing arm, wherein the spring is coupled to the drive rod at a connecting point on the spacing arm, and wherein the connecting point is offset from a center axis of the drive rod such that a force exerted by the spring at the connecting point urges rotation of the drive rod.

15. The furniture member of claim 14, wherein a distance that the connecting point is offset from the center axis of the drive rod changes as the drive rod rotates to vary a moment arm at which the force exerted by the spring pulls on the spacing arm to urge the drive rod to rotate.

16. The furniture member of claim 15, wherein the spring assist mechanism further includes a spring connector, wherein the spring connector has a curved shaped that connects the spring to the connecting point of the spacing arm such that the spring is spaced apart from the drive rod.

17. The furniture member of claim 16, wherein an end of the spacing arm opposite to the connecting point is secured to the drive rod such that the connecting point rotates with the drive rod.

18. The furniture member of claim 17, wherein the distance that the connecting point is offset from the center axis of the drive rod when the legrest is in the extended position is greater than the distance that the connecting point is offset from the center axis of the drive rod when the legrest is in the retracted position.

19. The furniture member of claim 18, wherein the trigger release mechanism includes a cam connected to the drive rod, and wherein the trigger engages the cam in the locked position to limit rotation of the drive rod and rotates away from the cam to disengage the cam in the released position to permit rotation of the drive rod.

20. A furniture member comprising:

a base frame;

a seat assembly including a seat frame, a seat bottom, a seatback and a legrest, the legrest movable relative to the base frame and seat frame between a retracted position and an extended position, the seatback movable relative to the base frame and seat frame between an upright position and a reclined position;

a drive rod rotatably mounted to the seat frame;

a legrest mechanism attached to the legrest and the seat frame and driven by the drive rod; and a trigger release mechanism connected to the seat frame and the drive rod, the trigger release mechanism operable between a locked position in which a trigger limits rotation of the drive rod and a released position in which the trigger permits rotation of the drive rod, wherein the seat assembly is connected to a wall-proximity mechanism that is connected to the base frame and the seat assembly to cause a weight of an occupant in the seat assembly to urge the drive rod to rotate to move the legrest mechanism from a retracted position to an extended position.

21. The furniture member of claim 20, wherein the seat frame is connected to the wall-proximity mechanism at a first connection point and at a second connection point, wherein the first connection point is positioned forward of the drive and the second connection point positioned rearward of the drive rod, wherein the second connection point is coupled to the drive rod by one or more connecting links, and wherein the weight of the occupant in the seat assembly exerts a force on the one or more connecting links urging the drive rod to rotate.

* * * * *